US009236171B2

(12) United States Patent
Ito et al.

(10) Patent No.: US 9,236,171 B2
(45) Date of Patent: Jan. 12, 2016

(54) COIL COMPONENT AND METHOD FOR PRODUCING SAME

(75) Inventors: Tomokazu Ito, Tokyo (JP); Hitoshi Ohkubo, Tokyo (JP); Yoshihiro Maeda, Tokyo (JP); Makoto Morita, Tokyo (JP); Toshiyuki Anbo, Tokyo (JP); Kyohei Tonoyama, Tokyo (JP); Manabu Ohta, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/880,039

(22) PCT Filed: Oct. 14, 2011

(86) PCT No.: PCT/JP2011/073645

§ 371 (c)(1),
(2), (4) Date: Apr. 17, 2013

(87) PCT Pub. No.: WO2012/053439

PCT Pub. Date: Apr. 26, 2012

(65) Prior Publication Data

US 2013/0222101 A1 Aug. 29, 2013

(30) Foreign Application Priority Data

Oct. 21, 2010 (JP) ..... 2010-236855
May 26, 2011 (JP) ..... 2011-118361

(51) Int. Cl.
*H01F 5/00* (2006.01)
*H01F 27/28* (2006.01)
(Continued)

(52) U.S. Cl.
CPC ..... *H01F 3/08* (2013.01); *H01F 5/003* (2013.01); *H01F 17/04* (2013.01); *H01F 27/324* (2013.01);
(Continued)

(58) Field of Classification Search
USPC ..... 336/200, 232, 223
See application file for complete search history.

(56) References Cited

U.S. PATENT DOCUMENTS 7,619,500 B1 11/2009 Nishikawa et al.
8,373,534 B2 * 2/2013 Kawarai ..... 336/200
(Continued)

FOREIGN PATENT DOCUMENTS

CN 101615479 A 12/2009
JP 2-014174 Y2 4/1990
(Continued)

OTHER PUBLICATIONS

International Preliminary Report on Patentability issued in International Application No. PCT/JP2011/0073645 issued on May 8, 2013.
(Continued)

*Primary Examiner* — Elvin G Enad
*Assistant Examiner* — Ronald Hinson
(74) *Attorney, Agent, or Firm* — McDermott Will & Emery LLP

(57) ABSTRACT

A coil component includes: an insulating resin layer provided between a first planar spiral conductor formed on a back surface of a first substrate and a second planer spiral conductor formed on a back surface of a second substrate; an upper core covering a third second planer spiral conductor formed on a front surface of the first substrate on which the insulating resin layer is formed; and a lower core covering a fourth planer spiral conductor formed on a front surface of the second substrate on which the insulating resin layer is formed. One of the upper and lower cores is formed of a metal-magnetic-powder-containing resin. The coil component includes connecting portions disposed respectively at center and outside portions of each of the first and second substrates so as to physically connect the upper and lower cores.

10 Claims, 30 Drawing Sheets

(51) Int. Cl.

| | |
|---|---|
| ***H01F 3/08*** | (2006.01) |
| ***H01F 17/04*** | (2006.01) |
| ***H01F 27/32*** | (2006.01) |
| ***H01F 41/04*** | (2006.01) |
| *H01F 27/255* | (2006.01) |

(52) U.S. Cl.

CPC ..... *H01F 41/04* (2013.01); *H01F 27/255* (2013.01); *H01F 2017/048* (2013.01); *Y10T 29/4902* (2015.01); *Y10T 29/49075* (2015.01)

(56) References Cited

U.S. PATENT DOCUMENTS

| | | | | |
|---|---|---|---|---|
| 2002/0017971 | A1 | 2/2002 | Koyama et al. | |
| 2010/0052838 | A1 * | 3/2010 | Matsuta et al. ..... | 336/200 |

FOREIGN PATENT DOCUMENTS

| | | | |
|---|---|---|---|
| JP | 2-022966 | Y2 | 6/1990 |
| JP | 8-203736 | A | 8/1996 |
| JP | 8-222438 | A | 8/1996 |
| JP | 11-340609 | A | 12/1999 |
| JP | 2000-277343 | A | 10/2000 |
| JP | 2001-110649 | A | 4/2001 |
| JP | 2001-345215 | A | 12/2001 |
| JP | 2002-118024 | A | 4/2002 |
| JP | 2005-210010 | A | 8/2005 |
| JP | 2006-040984 | A | 2/2006 |
| JP | 2006-278909 | A | 10/2006 |
| JP | 2006-310716 | A | 11/2006 |
| JP | 2008-072071 | A | 3/2008 |
| JP | 2009-253233 | A | 10/2009 |
| JP | 2010-034102 | A | 2/2010 |
| JP | 2010-080550 | A | 4/2010 |
| JP | 2010205905 | A | 9/2010 |
| WO | WO-2007/069403 | A1 | 6/2007 |

OTHER PUBLICATIONS

International Search Report issued in International Applicaiton No. PCT/JP2011/073645 mailed Jan. 17, 2012.

* cited by examiner

COIL COMPONENT AND METHOD FOR PRODUCING SAME

RELATED APPLICATIONS

This application is the U.S. National Phase under 35 U.S.C. §371 of International Application No. PCT/JP2011/073645, filed on Oct. 14, 2011, which in turn claims the benefit of Japanese Application Nos. 2010-236855, filed on Oct. 21, 2010, and 2011-118361, filed May 26, 2011 the disclosures of which Applications are incorporated by reference herein.

TECHNICAL FIELD

The present invention relates to a coil component and its manufacturing method and, more particularly, to a coil component suitably usable as a power supply inductor and a coil component having a plane spiral conductor formed on a printed circuit board by electrolytic plating and its manufacturing method.

BACKGROUND ART

A surface-mounting type coil component is now widely used in consumer or industrial electronic equipment. Particularly, in small mobile equipment, there has occurred, along with its enhancement of functionality, a need to obtain a plurality of voltages from a single power supply in order to drive various devices provided therein. Such a coil component for power supply use is demanded to be small/thin, excellent in insulating performance and electrical reliability, and to be manufactured at low cost.

As a structure of a coil component that meets the above requirement, a planar coil structure based on a printed circuit board technology is known. The coil component of such a type has a structure in which planar coil patterns are formed respectively on both top and back surfaces of a printed circuit board and the printed circuit board is sandwiched between, e.g., EE type or EI type of sintered ferrite cores. With this configuration, a closed magnetic path is formed around the planar coil patterns.

The coil component for power supply use is required not to exhibit a decrease in inductance thereof due to magnetic saturation even when a certain high direct bias current is applied thereto. To meet the above requirement, a coil component described in Patent Document 1 has first and second magnetic layers covering upper and lower surfaces of an insulating substrate on each of which a planar spiral conductor is formed, and these two magnetic layers each have a gap in a thickness direction at an outer edge area of the coil pattern. This can suppress magnetic saturation in a magnetic circuit to increase an inductance of the magnetic circuit.

Patent Document 2 discloses a coil component having a structure in which an air-core coil is embedded in a packaging resin to be integrated therewith. This coil component includes a resin containing metal magnetic powder. In particular, by using a compound material in which two or more types of amorphous metal magnetic powder having different average particle diameters and an insulating binder are mixed with each other, it is possible to obtain high density, high magnetic permeability, and low core loss even under low pressure molding conditions.

In a field of commercial or industrial electronic equipment, the surface-mounting type coil component has come to be used frequently as a power supply inductor. This is because the surface-mounting type coil component is small/thin, excellent in insulating performance, and capable of being manufactured at low cost.

A planar coil structure using a printed circuit board technology is known as one of a specific structure of the surface-mounting type coil component. The following briefly describes the planar coil structure in terms of a manufacturing process thereof. First, a seed layer (base film) having a planar spiral conductor shape is formed on a printed circuit board. Then, the resultant circuit board is immersed in plating solution, and DC current (hereinafter, referred to as "plating current") is applied to the seed layer to cause metal ions in the plating solution to be electrodeposited onto the seed layer. As a result, a planar spiral conductor is formed and, thereafter, an insulating resin layer covering the formed planar spiral conductor and a metal-magnetic-powder-containing resin layer serving as both of a protective layer and a magnetic path are sequentially formed, whereby manufacturing of the coil component is completed. This structure allows high dimensional and positional accuracy to be maintained, as well as, a reduction in size and thickness. Patent Document 1 discloses a planar coil element having such a planar coil structure.

CITATION LIST

Patent Documents

[Patent Document 1] Japanese Patent Application Laid-Open Publication No. 2006-310716

[Patent Document 2] Japanese Patent Application Laid-Open Publication No. 2010-034102

SUMMARY OF THE INVENTION

Problems to be Solved by the Invention

In the conventional coil component disclosed in Patent Document 1, it is necessary to form a gap in order to increase an inductance. However, adjustment of a width of the gap is very difficult in terms of assembly accuracy or processing accuracy.

The conventional coil component described in Patent Document 2 uses a resin containing metal magnetic powder as a core material; however, since the conventional coil component uses an air-core coil formed by winding a wire, a size of the entire coil component is very large. In addition, it is difficult to maintain a shape of the coil, which poses a problem that an inner diameter of the coil and a position of the air-core coil are varied significantly.

An object of the present invention is therefore to provide a high-performance coil component which is excellent in DC superimposition characteristics and which does not require formation of a magnetic gap. Another object of the present invention is to provide a coil component which is high in dimension processing accuracy and which is small and thin.

A coil component used as a power supply inductor is required to have a possibly low DC resistance. Thus, a plan is being studied in which a plurality of substrates (hereinafter, referred to as "basic coil component") on both surfaces of each of which a planar spiral conductor is formed are laminated and connected in parallel.

If the plurality of the basic coil components are simply laminated, opposing two planer spiral conductors are brought into contact with each other. If the two planar spiral conductors make contact with each other between the same turns with respect to all turns, the contact is equivalent to an increase in a film thickness of the planer spiral conductor.

Therefore, no problem occurs in terms of characteristics. However, since it is not possible to completely control positions of the two basic coil components practically, it is inevitable that some displacement occurs. Therefore, there is a possibility that a contact between the turns which are not the same turns occurs.

Still another object of the present invention is therefore to provide a coil component capable of preventing, in a case where a plurality of basic coil components are laminated, two opposing planar spiral conductors from contacting each other except for contacts between the same turns, and its manufacturing method.

Means for Solving the Problems

A coil component according to the present invention includes: a first substrate; a second substrate disposed such that a top surface thereof faces a back surface of the first substrate; first and second planar spiral conductors formed, by electrolytic plating, on the top and back surfaces of the first substrate, respectively, inner peripheral ends thereof being connected to each other through a first through hole conductor penetrating the first substrate; third and fourth planar spiral conductors formed, by electrolytic plating, on the top and back surfaces of the second substrate, respectively, inner peripheral ends thereof being connected to each other through a second through hole conductor penetrating the second substrate; an insulating layer formed between the second planer spiral conductor and third planar spiral conductor; a first external electrode connected to an outer peripheral end of the first planar spiral conductor and an outer peripheral end of the fourth planar spiral conductor; a second external electrode connected to an outer peripheral end of the second planar spiral conductor and an outer peripheral end of the third planar spiral conductor; a first insulating resin layer covering the first planar spiral conductor; an upper core covering the top surface of the first substrate on which the first insulating resin layer is formed; a second insulating resin layer covering the second planar spiral conductor; and an lower core covering the back surface of the second substrate on which the second insulating resin layer is formed. At least one of the upper and lower cores is formed of a metal-magnetic-powder-containing resin. The coil component further includes connecting portions disposed respectively at center and outside portions of each of the first and second substrates so as to physically connect the upper and lower cores.

According to the present invention, it is possible to provide a high-performance coil component capable of exhibiting excellent DC superimposition characteristics and capable of eliminating the need to form a magnetic gap. Further, there can be provided a coil component capable of achieving a high dimension processing accuracy and capable of reducing the size and thickness. Further, formation of the insulating film can prevent the facing second and third planar spiral conductors from being brought into contact with each other.

In the above coil component, film thicknesses of innermost and outermost turns of each of the second and third planar spiral conductors may be larger than those of the other turns thereof. A top surface of the innermost turns of the second planer spiral conductor and a top surface of the innermost turn of the third planar spiral conductor may penetrate the insulating layer to be brought into contact with each other. Atop surface of the outermost turn of the second planer spiral conductor and a top surface of the outermost turn of the third planar spiral conductor may penetrate the insulating layer to be brought into contact with each other. Top surfaces of turns of the second planar spiral conductor other than the innermost and outermost turns and top surfaces of turns of the third planar spiral conductor other than the innermost and outermost turns may be electrically isolated from each other by the insulating layer.

A coil component according to an aspect of the present invention includes: at least one insulating substrate; a spiral conductor formed on at least one main surface of the insulating substrate, an upper core covering the one main surface of the insulating substrate; and a lower core covering the other main surface of the insulating substrate. At least one of the upper and lower cores is formed of a metal-magnetic-powder-containing resin. The coil component further includes connecting portions disposed respectively at center and outside portions of the insulating substrate so as to physically connect the upper and lower cores.

According to the present invention, the metal-magnetic-powder-containing resin is used as a material of a closed magnetic path, so that a resin exists between the metal magnetic powder particles to form minute gaps. This increases a saturation flux density, eliminating the need to form a gap, unlike a case where a ferrite core is used. Therefore, it is not necessary to perform machine processing for the magnetic core with high accuracy, and a small and thin coil component can be provided.

In the present invention, both the upper and lower cores are preferably formed of the metal-magnetic-powder-containing resin. With this configuration, the entire magnetic core is formed of the metal-magnetic-powder-containing resin, so that a coil component having sufficiently high DC superimposition characteristics can be provided.

In the present invention, it is preferable that one of the upper and lower cores is formed of the metal-magnetic-powder-containing resin and the other one thereof is formed of a ferrite substrate. With this configuration, a metal-magnetic-powder-containing resin paste can be applied by using the ferrite substrate as a support substrate, thereby facilitating formation of the magnetic core using the metal-magnetic-powder-containing resin. Further, a saturation flux density can be sufficiently increased by the magnetic core formed of the metal-magnetic-powder-containing resin, so that even if one of the cores is formed of the ferrite substrate, there can be provided a coil component capable of exhibiting high DC superimposition characteristics without forming a gap.

In the present invention, the connecting portions each connecting the upper and lower cores are preferably disposed at respective four corner portions of the insulating substrate. Formation of the closed magnetic paths at the four corners results in an increase in an area for forming the spiral conductor, thereby increasing a loop size. This can achieve a low coil resistance, a high inductance, and a reduction in size. Further, the connecting portions can be formed by using a comparatively wide margin area in which the spiral conductor is not formed, thereby increasing a sectional area of the closed magnetic path.

In the case where the connecting portions each connecting the upper and lower cores are disposed at the respective four corners of the insulating substrate, the connecting portions at the respective four corners may be disposed in contact with an edge of each of the corner portions of the insulating substrate or may be disposed inward of the edge thereof. In the case where the connecting portions at the respective four corners are disposed in contact with the edge of each of the corner portions of the insulating substrate, the connecting portions can be processed easily at the mass production. That is, the connecting portions of the individual chips can be formed by forming a connecting portion common to adjacent four chips and dividing it into four parts. On the other hand, in the case where the connecting portions are disposed inward of the edge of each of the corner portions of the insulating substrate, a plating conductor pattern to be described later can be easily disposed.

The coil component according to the present invention further preferably includes a plating conductor pattern formed on the one main surface of the insulating substrate. One end of the plating conductor pattern is preferably electrically connected to the spiral conductor and the other end thereof extends up to the edge of the insulating substrate. Further, at the mass production time when a plurality of coil components are formed on a single substrate, the plating conductor pattern preferably constitutes a part of a short-circuiting pattern electrically connecting the spiral conductors of adjacent coil components. With this configuration, the conductor pattern of a plurality of adjacent chips can be subjected to plating at a time, thereby increasing efficiency of the manufacturing process.

The coil component according to the present invention further preferably includes a pair of terminal electrodes formed on outer peripheral surfaces of a laminated body constituted by the insulating substrate and the upper and lower cores, and an insulating film covering surfaces of the upper and lower cores. Preferably, the insulating film is interposed between the pair of terminal electrodes and the upper and lower cores. In this case, the insulating film is preferably an insulating layer obtained by chemical conversion treatment using iron phosphate, zinc phosphate, or zirconia dispersed solution. With this configuration, insulation between the pair of terminal electrodes can be ensured.

In the present invention, the insulating film is also preferably formed of an Ni-based-ferrite-containing resin. With this configuration, the insulating film can be made to function as a part of the closed magnetic path.

The coil component according to the present invention preferably includes a plurality of the insulating substrates. The plurality of insulating substrates are preferably laminated substantially without intervention of the metal-magnetic-powder-containing resin, and the spiral conductors formed on the respective insulating substrates are connected in parallel or in series through the pair of terminal electrodes. There is a limit to a sectional area of the spiral conductor that can be formed on the insulating substrate; however, by laminating a plurality of insulating substrates and connecting the spiral conductors formed on the respective insulating substrates in parallel, a configuration equivalent to that in which the sectional area of the spiral conductor is increased can be obtained. Further, by connecting the spiral conductors formed on the respective insulating substrates in series, the number of turns of the coil required in each substrate is reduced, so that it is possible to increase a wire width and a wire thickness of the spiral conductor, thereby sufficiently increasing the sectional area of the spiral conductor. As a result, a DC resistance of the coil component can be reduced.

A coil component according to another aspect of the present invention includes: a first substrate; a second substrate disposed such that a top surface thereof faces to a back surface of the first substrate; first and second planar spiral conductors formed, by electrolytic plating, on the top and back surfaces of the first substrate, respectively, inner peripheral ends thereof being connected to each other through a first through hole conductor penetrating the first substrate; third and fourth planar spiral conductors formed, by electrolytic plating, on the top and back surfaces of the second substrate, respectively, inner peripheral ends thereof being connected to each other through a second through hole conductor penetrating the second substrate; an insulating layer formed between the second planer spiral conductor and third planar spiral conductor; a first external electrode connected to an outer peripheral end of the first planar spiral conductor and an outer peripheral end of the fourth planar spiral conductor; and a second external electrode connected to an outer peripheral end of the second planar spiral conductor and an outer peripheral end of the third planar spiral conductor.

According to the present invention, formation of the insulating layer can prevent the facing second and third planer spiral conductors from being brought into contact with each other.

In the above coil component, film thicknesses of innermost and outermost turns of each of the second and third planar spiral conductors may be larger than those of the other turns thereof. A top surface of the innermost turn of the second planer spiral conductor and a top surface of the innermost turn of the third planar spiral conductor may penetrate the insulating layer to be brought into contact with each other. Atop surface of the outermost turn of the second planer spiral conductor and a top surface of the outermost turn of the third planar spiral conductor may penetrate the insulating layer to be brought into contact with each other. Top surfaces of turns of the second planar spiral conductor other than the innermost and outermost turns and top surfaces of turns of the third planar spiral conductor other than the innermost and outermost turns may be electrically isolated from each other by the insulating layer. With the above configuration, even if the displacement occurs between the second and third planar spiral conductors, it is avoided that the contact between a given turn of one of the second and third planer spiral conductors and a different turn of the other one thereof occurs. Further, it is possible to bring the two planar spiral conductors close to each other to such a degree that the innermost and outermost turns thereof contact each other, thereby achieving a high inductance and a reduction in height. That the film thicknesses of the innermost and outermost turns of the respective second and third planar spiral conductors are larger than those of the other turns thereof is a feature of the electrolytic plating.

In the above coil component, the film thicknesses of the turns of the second planar spiral conductors may be made uniform, and the film thicknesses of the turns of the third planar spiral conductors may be made uniform. The uniformity in the film thicknesses of the turns of each of the second and third planar spiral conductors each of which is formed by the electrolytic plating indicates that the film thicknesses of the respective innermost and outermost turns are reduced after the electrolytic plating. Thus, according to the above coil component, a distance (distance between top surfaces) between the second and third planar spiral conductors each formed by the electrolytic plating can be minimized, thereby achieving a high inductance and a reduction in height.

Further, in the above coil component, the film thicknesses of the turns of the first planar spiral conductor may be made uniform, and the film thicknesses of the turns of the fourth planar spiral conductor may be made also uniform. This further reduces the height.

The above each coil component may further include an insulating resin layer covering the first and fourth planar spiral conductors and a metal-magnetic-powder-containing resin layer covering the top surface of the first substrate and the back surface of the second substrate on each of which the insulating resin layer is formed. With this configuration, it is possible to obtain a power supply choke coil excellent in DC superimposition characteristics.

A manufacturing method of a coil component according to the present invention includes: a conductor formation step of forming first and second planar spiral conductors on respective top and back surfaces of a first substrate by electrolytic plating, forming a first through hole conductor penetrating the first substrate so as to connect an inner peripheral end of the first planar spiral conductor and an inner peripheral end of the second planar spiral conductor, forming third and fourth planar spiral conductors on respective top and back surfaces of the second substrate by the electrolytic plating, and forming a second through hole conductor penetrating the second substrate so as to connect an inner peripheral end of the third planar spiral conductor and an inner peripheral end of the fourth planar spiral conductor; an insulating resin layer formation step of forming a first insulating resin layer covering top surfaces of turns of the second planar spiral conductor other than at least the outermost and innermost turns and forming a second insulating resin layer covering top surfaces of turns of the third planar spiral conductor other than at least the outermost and innermost turns; a lamination step of laminating the first and second substrates such that the back surface of the first substrate and the top surface of the second substrate face each other; and an external electrode formation step of forming a first external electrode connecting an outer peripheral end of the first planar spiral conductor and an outer peripheral end of the fourth planar spiral conductor and a second external electrode connecting an outer peripheral end of the second planar spiral conductor and an outer peripheral end of the third planar spiral conductor.

According to the present invention, formation of the first and second insulating resin layers can prevent the facing second and third planar spiral conductors from being brought into physical contact with each other, excluding at least contacts between outermost turns and between innermost turns.

In the above coil component manufacturing method, the first insulating resin layer may cover also the top surfaces of the outermost and innermost turns of the second planar spiral conductor, and the second insulating resin layer may cover also the top surfaces of the outermost and innermost turns of the third planar spiral conductor. The insulating resin layer formation step may include a grinding step of applying grinding to the surface of the first insulating resin layer to expose the top surfaces of the outermost and innermost turns of the second planar spiral conductor from the surface of the first insulating resin layer and applying grinding to the surface of the second insulating resin layer to expose the top surfaces of the outermost and innermost turns of the third planar spiral conductor from the surface of the second insulating resin layer. The lamination step may laminate the first and second substrates in a state where the top surfaces of the outermost and innermost turns of the second planar spiral conductor are exposed from the surface of the first insulating resin layer and where the top surfaces of the outermost and innermost turns of the third planar spiral conductor are exposed from the surface of the second insulating resin layer. With the above configuration, even if a displacement occurs between the second and third planar spiral conductors, the contact between a given turn of one of the second and third planer spiral conductors and a different turn of the other one thereof does not occur. Further, it is possible to bring the two planar spiral conductors close to each other to such a degree that the innermost and outermost turns thereof contact each other, thereby achieving a high inductance and a reduction in height.

In the above coil component manufacturing method, the insulating resin layer formation step may include a grinding step of applying grinding to the surface of the first insulating resin layer to expose the top surfaces of respective turns of the second planar spiral conductor from the surface of the first insulating resin layer and applying grinding to the surface of the second insulating resin layer to expose the top surfaces of respective turns of the third planar spiral conductor from the surface of the second insulating resin layer, and a step of forming a third insulating resin layer covering at least one of the surfaces of the first and second insulating resin layers. The top surfaces of the respective turns of the second planar spiral conductor and top surfaces of the respective turns of the third planar spiral conductor may be electrically isolated from each other by the third insulating resin layer. As a result, it is possible to minimize a distance (distance between top surfaces) between the second and third planar spiral conductors each formed by electrolytic plating, thereby achieving a high inductance and a reduction in height.

The above coil component manufacturing method may further include, after the lamination step, a step of forming a fourth insulating resin layer covering the first and fourth planar spiral conductors and further forming a metal-magnetic-powder-containing resin layer covering the surfaces the first and fourth planar spiral conductors on which the fourth insulating resin layer is formed, and a step of forming an insulating layer on a surface of the metal-magnetic-powder-containing resin layer. The external electrode formation step may form the first and second external electrodes after the formation of the insulating layer. With this configuration, it is possible to obtain a power supply choke coil excellent in DC superimposition characteristics.

Further, in the above coil component manufacturing method, the insulating resin layer formation step may further include a step of forming the first insulating resin layer so as to cover also the first planar spiral conductor, forming the second insulating resin layer so as to cover the fourth planar spiral conductor and forming a metal-magnetic-powder-containing resin layer covering the surfaces the first and fourth planar spiral conductors on which the first and second insulating resin layers are formed, and a step of forming an insulating layer on a surface of the metal-magnetic-powder-containing resin layer. The external electrode formation step may form, after the formation of the insulating layer, the first and second external electrodes. With this configuration, it is possible to obtain a power supply choke coil excellent in DC superimposition characteristics.

Advantages of the Invention

According to the present invention, it is possible to provide a high-performance coil component capable of exhibiting excellent DC superimposition characteristics and capable of eliminating the need to form a magnetic gap. Further, there can be provided a coil component capable of achieving a high dimension processing accuracy and capable of reducing the size and thickness. Further, formation of the insulating layer can prevent the facing second and third planar spiral conductors from being brought into contact with each other.

BRIEF DESCRIPTION OF THE DRAWINGS

FIGS. 3A and 3B are schematic side cross-sectional views of the coil component 10 of FIG. 2 wherein FIG. 3A is a cross-sectional view taken along an X-X line and FIG. 3B is a cross-sectional view taken along a Y-Y line of FIG. 2;

FIGS. 4A and 4B are views illustrating a manufacturing process of the coil component 10 wherein FIG. 4A is a schematic plan view and FIG. 4B is a schematic side cross-sectional view;

FIGS. 5A and 5B are views illustrating a manufacturing process of the coil component 10 wherein FIG. 5A is a schematic plan view and FIG. 5B is a schematic side cross-sectional view;

FIGS. 6A and 6B are views illustrating a manufacturing process of the coil component 10 wherein FIG. 6A is a schematic plan view and FIG. 6B is a schematic side cross-sectional view;

FIGS. 7A and 7B are views illustrating a manufacturing process of the coil component 10 wherein FIG. 7A is a schematic plan view and FIG. 7B is a schematic side cross-sectional view;

FIGS. 13A and 13B are views illustrating a manufacturing process of the coil component 50 wherein FIG. 13A is a schematic plan view and FIG. 13B is a schematic side cross-sectional view;

FIGS. 16A and 16B are schematic views each illustrating a structure of a coil component 70 according to a seventh embodiment of the present invention wherein FIG. 16A shows a three-terminal electrode structure and FIG. 16B shows a four-terminal electrode structure;

FIGS. 23A and 23B are views illustrating the basic coil component according to the eighth embodiment of the present invention during the mass production process wherein FIG. 23A is a plan view illustrating the substrate before cutting as viewed from the top surface side, and FIG. 23B is a cross-sectional view taken along a B-B line of FIG. 23A;

FIGS. 24A and 24B are views illustrating the basic coil component according to the eighth embodiment of the present invention during the mass production process wherein FIG. 24A is a plan view illustrating the substrate before cutting as viewed from the top surface side, and FIG. 24B is a cross-sectional view taken along a B-B line of FIG. 24A;

FIGS. 25A and 25B are views illustrating the basic coil component according to the eighth embodiment of the present invention during the mass production process wherein FIG. 25A is a plan view illustrating the substrate before cutting as viewed from the top surface side, and FIG. 25B is a cross-sectional view taken along a B-B line of FIG. 25A;

FIGS. 26A and 26B are views illustrating the basic coil component according to the eighth embodiment of the present invention during the mass production process wherein FIG. 26A is a plan view illustrating the substrate before cutting as viewed from the top surface side, and FIG. 26B is a cross-sectional view taken along a B-B line of FIG. 26A;

FIGS. 27A and 27B are views illustrating the basic coil component according to the eighth embodiment of the present invention during the mass production process wherein FIG. 27A is a plan view illustrating the substrate before cutting as viewed from the top surface side, and FIG. 27B is a cross-sectional view taken along a B-B line of FIG. 27A;

DETAILED DESCRIPTION OF THE EMBODIMENTS

Preferred embodiments of the present invention will be described in detail hereinafter with reference to the accompanying drawings.

Figure 1:
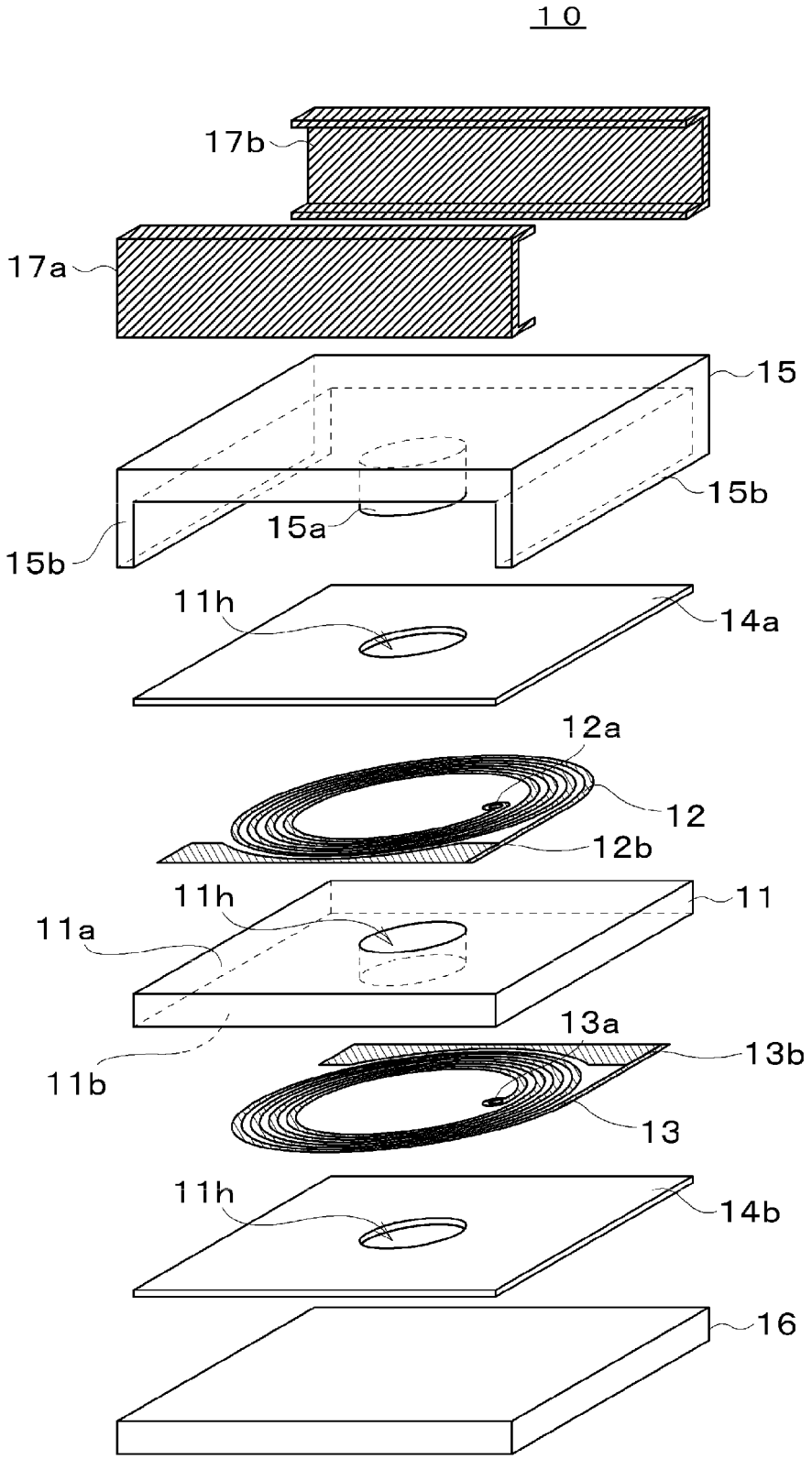
FIG. 1 is a schematic exploded perspective view illustrating a structure of a coil component 10 according to a first embodiment of the present invention.
Figure 2:
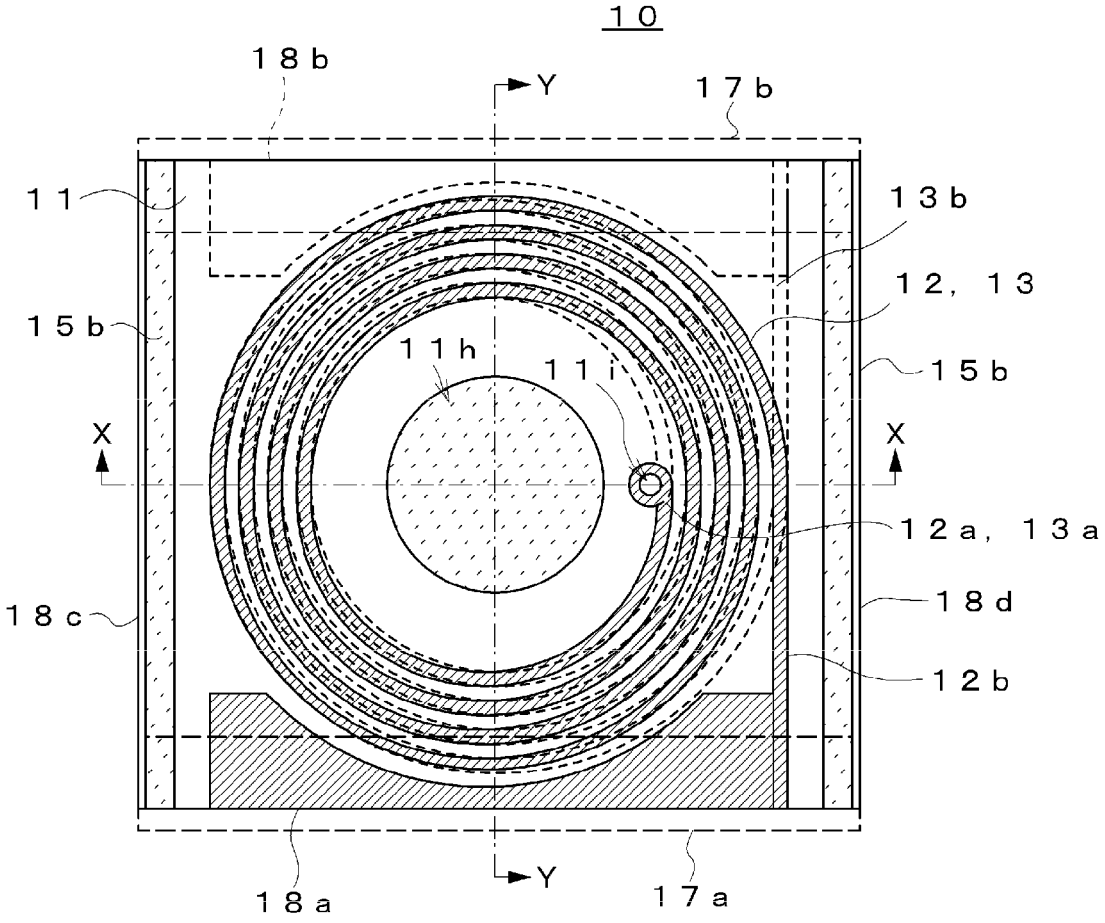
FIG. 2 is a schematic plan view illustrating the coil component 10 shown in FIG. 1.
Figure 3A:
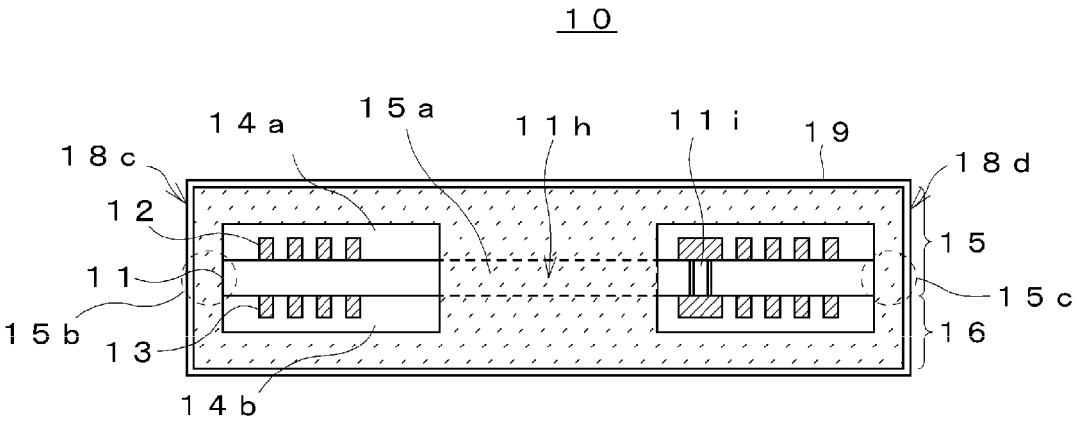
Figure 3B:
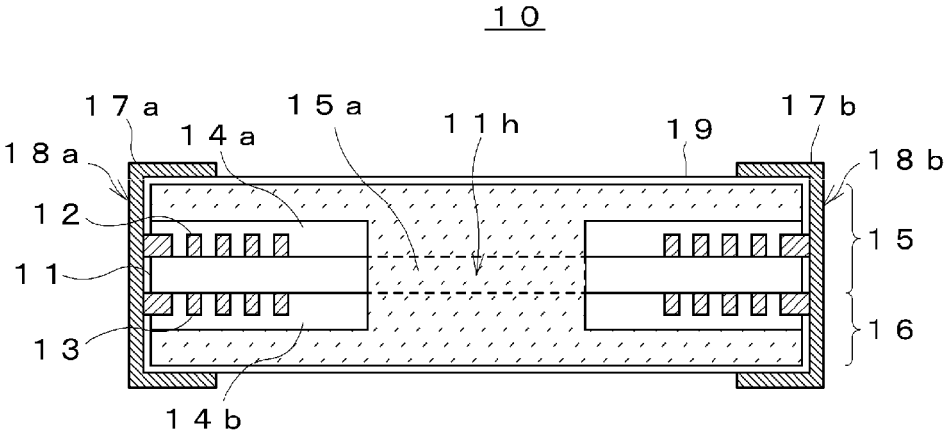

FIG. 1 is a schematic exploded perspective view illustrating a structure of a coil component 10 according to a first embodiment of the present invention. FIG. 2 is a schematic plan view illustrating the coil component 10 shown in FIG. 1. FIGS. 3A and 3B are schematic side cross-sectional views of the coil component 10 taken along an X-X line and a Y-Y line of FIG. 2, respectively.

As illustrated in FIGS. 1 to 3, the coil component 10 according to the first embodiment includes an insulating substrate 11, a first spiral conductor 12 formed on one main surface (upper surface 11*a*) of the insulating substrate 11, a second spiral conductor 13 formed on the other main surface (back surface 11*b*) of the insulating substrate 11, insulating resin layers 14*a* and 14*b* covering the first and second spiral conductors 12 and 13, respectively, an upper core 15 covering an upper surface 11*a* side of the insulating substrate 11, a lower core 16 covering a back surface 11*b* side of the insulating substrate 11, and a pair of terminal electrodes 17*a* and 17*b*.

The insulating substrate 11 serves as a base layer for forming the first and second spiral conductors 12 and 13. The insulating substrate 11 is formed into a rectangular shape and has, at a center portion thereof, a circular opening 11*h*. The insulating substrate 11 is preferably formed of a common printed board material obtained by impregnating a glass fiber cloth with an epoxy resin. For example, a BT base material, an FR4 base material, an FR5 base material, or the like may be used. In a case where the printed board material is used, the spiral conductor can be formed by plating, not by sputtering in so-called a thin film method, so that a thickness of the conductor can be made sufficiently large. In order to avoid an increase in floating capacitance, a dielectric constant of the insulating substrate 11 is preferably equal to or less than 7 ($\mu \leq 7$). Although not especially limited, a dimension of the insulating substrate 11 can be set to, e.g., 2.5 mm×2.0 mm×0.3 mm.

The first and second spiral conductors 12 and 13 are each a circular spiral and are each disposed so as to surround the opening 11*h* of the insulating substrate 11. Although the first and second spiral conductors 12 and 13 are roughly overlapped with each other as viewed from the above, they do not completely coincide with each other. That is, the first spiral conductor 12 forms a counterclockwise spiral extending from an outer peripheral end 12*b* to an inner peripheral end 12*a* as viewed from the upper surface 11*a* side of the insulating substrate 11, and the second spiral conductor 13 forms a counterclockwise spiral extending from an inner peripheral end 13*a* to an outer peripheral end 13*b* as viewed from also the upper surface 11*a* side of the insulating substrate 11. With this configuration, directions of magnetic fluxes generated upon flowing of current through the spiral conductors 12 and 13 are made coincide with each other. As a result, the magnetic fluxes generated in the spiral conductors 12 and 13 are superimposed to reinforce one another, thereby allowing a high inductance to be obtained.

The pair of terminal electrodes 17*a* and 17*b* are mounted to two opposing side surfaces 18*a* and 18*b*, respectively, of a laminated body constituted by the insulating substrate 11, upper core 15, and lower core 16. The outer peripheral end 12*b* of the first spiral conductor 12 is drawn up to the first side surface 18*a* and connected to the terminal electrode 17*a*. The outer peripheral end 13*b* of the second spiral conductor 13 is drawn up to the second side surface 18*b* and connected to the terminal electrode 17*b*. The inner peripheral end 12*a* of the first spiral conductor 12 and inner peripheral end 13*a* of the second spiral conductor 13 are connected to each other through a through hole conductor 11*i* penetrating the insulating substrate 11. Thus, the first and second spiral conductors 12 and 13 are connected in series to constitute a single coil.

As a material for the first and second spiral conductors 12 and 13, Cu having a high conductivity and being easily processed is preferably used. Although not especially limited, a width, height, and a pitch of each of the first and second spiral conductors 12 and 13 can be set to 70 μm, 120 μm, and 10 μm, respectively. Such first and second spiral conductors 12 and 13 are each preferably formed by plating. In a case where the first and second spiral conductors 12 and 13 are formed by plating, an aspect ratio thereof can be increased and, thus, a coil having a comparatively large cross section and having a low DC resistance can be formed.

The upper and lower cores 15 and 16 are each formed of a metal-magnetic-powder-containing resin. In the present embodiment, the upper and lower cores 15 and 16 are formed of the same material and formed integrally, so that a boundary between them is not clear in appearance; actually, however, the upper core 15 is formed as an E-type core including a flat-plate portion and a columnar portion (connecting portion) protruding downward from the flat-plate portion, and the lower core 16 is formed as an I-type core constituted by a plate-like portion.

The upper core 15 are connected to the lower core 16 through a connecting portion 15*a* provided in a center portion of a rectangular flat area and two connecting portions 15*b* formed along two opposing side surfaces 18*c* and 18*d*, whereby a completely-closed magnetic path is formed. That is, the connecting portions 15*a* and 15*b* penetrate the insulating substrate 11 and insulating resin layers 14*a* and 14*b* and, thus, no gap exists in the closed magnetic path. In a case where sintered ferrite cores are used, a gap needs to be formed so as not to cause magnetic saturation even if a certain level or more of current is made to flow; on the other hand, in a case where the metal-magnetic-powder-containing resin is used, the resin exists between the metal magnetic particles to form minute gaps. This increases a saturation flux density, so that it is possible to prevent the magnetic saturation without forming an air gap between the upper and lower cores 15 and 16. Therefore, it is not necessary to perform machine processing for the magnetic core with high accuracy in order to form a gap.

The metal-magnetic-powder-containing resin is a magnetic material obtained by mixing metal magnetic powder in the resin. As the metal magnetic powder, a permalloy-based material is preferably used. Specifically, it is preferably to use metal magnetic powder obtained by mixing a Pb—Ni—Co alloy having an average particle diameter of 20 μm to 50 μm, which is used as first metal magnetic powder and carbonyl iron having an average particle diameter of 3 μm to 10 μm, which is used as second metal magnetic powder, at a predetermined weight ratio (e.g., 70:30 to 80:20, preferably, 75:25). A content percentage of the metal magnetic powder is preferably 90% by weight to 96% by weight. Alternatively, the content percentage of the metal magnetic powder may be 96% by weight to 98% by weight. When an amount of the metal magnetic powder relative to the resin is reduced, the saturation flux density is reduced and, conversely, when the amount of the metal magnetic powder relative to the resin is increased, the saturation flux density is increased. That is, by controlling only the amount of the metal magnetic powder, the saturation flux density can be controlled.

It is particularly preferable to use metal magnetic powder obtained by mixing the first metal magnetic powder having an average particle diameter of 5 μm and the second metal magnetic powder having an average particle diameter of 50 μm at a predetermined ratio, e.g., 75:25. When the two kinds of metal magnetic powder having different particle diameters are used as described above, a high-density magnetic core can be formed under low pressure or non-pressure conditions, thereby achieving a magnetic core having high permeability and low core loss.

The resin contained in the metal-magnetic-powder-containing resin functions as an insulating binder. As a material for the resin, a liquid epoxy resin or a powder epoxy resin is preferably used. A content percentage of the resin is preferably 4% by weight to 10% by weight.

The upper and lower cores 15 and 16 preferably have the same thickness, and a sum of the thicknesses thereof is preferably 0.3 mm to 1.2 mm. When the sum of the thicknesses of the upper and lower cores 15 and 16 is smaller than 0.3 mm, not only mechanical strength of the component, but also the inductance of the coil is reduced, and when the sum of the thicknesses is larger than 1.2 mm, the inductance is saturated and not increased any more despite an increase in the thickness of the component.

In the present embodiment, an insulating film 19 is preferably formed on surfaces of the upper and lower cores and 16. The insulating film 19 can be formed by chemical conversion treatment, andiron phosphate, zinc phosphate, or zirconia is preferably used in the chemical conversion treatment. When the metal-magnetic-powder-containing resin is used as the material constituting the closed magnetic path as described above, an insulating property between the terminal electrodes 17*a* and 17*b* becomes an issue because the metal magnetic powder is a conductor. However, according to the present embodiment, a surface of the metal-magnetic-powder-containing resin is insulating-coated, so that it is possible to ensure a sufficient insulating property between the terminal electrodes 17*a* and 17*b*.

FIGS. 4 to 7 are views illustrating a manufacturing process of the coil component 10 wherein FIGS. 4A to 7A are schematic plan views and FIGS. 4B to 7B are schematic side cross-sectional views.

Figure 4A:
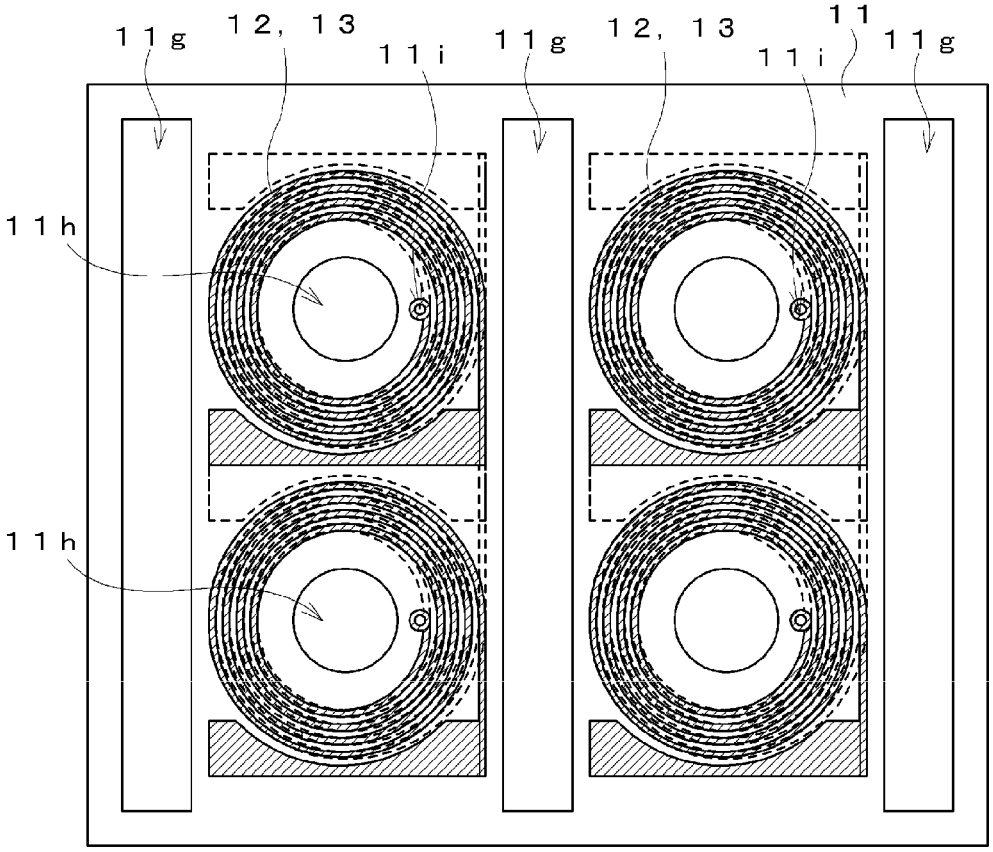
Figure 4B:
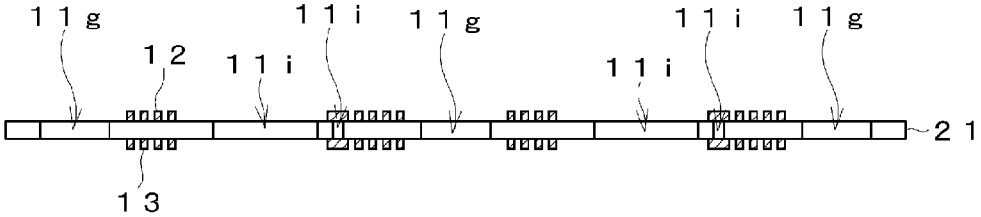

In the manufacturing process of the coil component 10, as illustrated in FIGS. 4A and 4B, so-called amass production process in which a plurality of (four, in this example) coil components are formed on a large insulating substrate (assembly substrate) is carried out. Specifically, slits 11*g*, the openings 11*h*, and the through holes 11*i* are formed at predetermined positions of the large insulating substrate 11 and, thereafter, the first and second spiral conductors 12 and 13 are formed on the upper and back surfaces 11*a* and 11*b* of the insulating substrate 11, respectively. In the present embodiment, the spiral conductors 12 and 13 are formed by plating. More specifically, a Cu base film is formed on substantially the entire surface of the insulating substrate 11 by way of electroless plating. At this time, a Cu film is formed inside the through holes 11*i*. Thereafter, a photoresist is exposed and developed to form an opening pattern (negative pattern) having the same shape as the spiral conductors 12 and 13.

Subsequently, electrolytic plating is performed using the resist pattern as a mask to form a thick Cu film on the Cu base film. Thereafter, the resist is removed, and the base film is removed by etching to leave only the spiral conductors. With the above procedure, an insulating substrate (hereinafter, TFC (Thin Film Coil) substrate 21) on which the spiral conductors are formed is obtained.

Figure 5A:
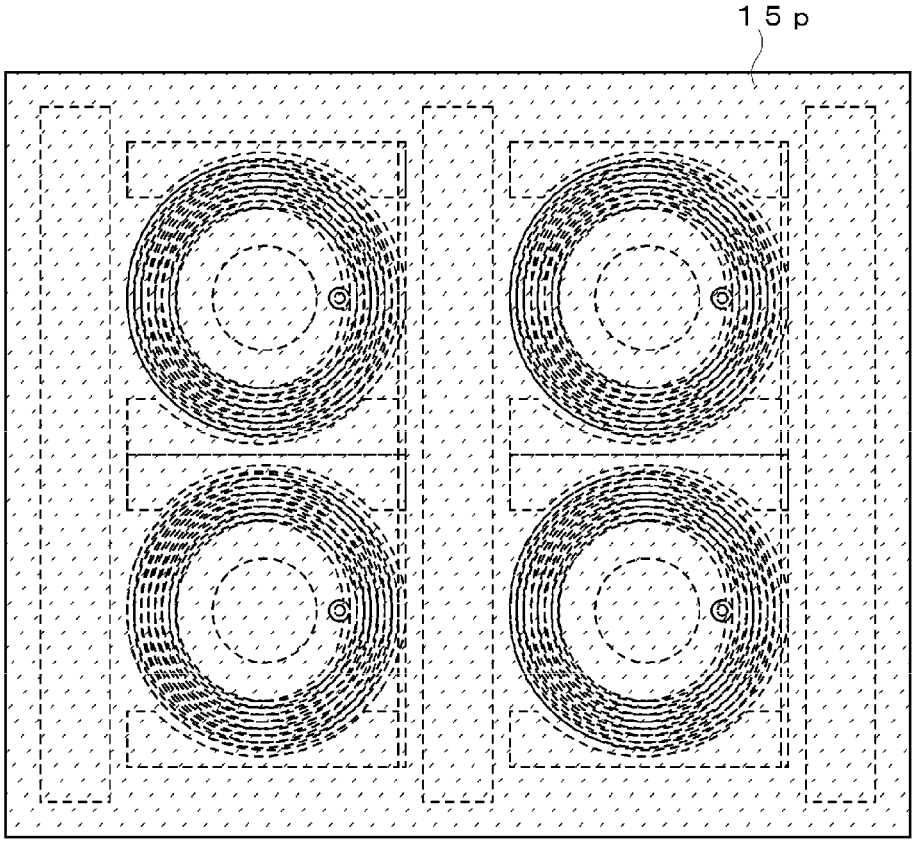
Figure 5B:
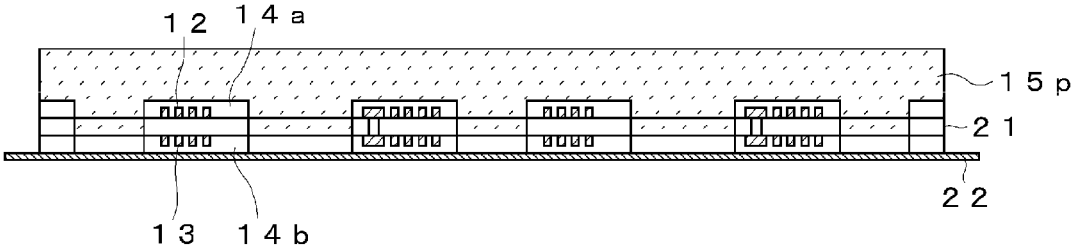

Subsequently, as illustrated in FIGS. 5A and 5B, the insulating resin layers 14*a* and 14*b* are formed on both surfaces of the TFC substrate 21, respectively, and a back surface of the TFC substrate 21 is attached and fixed to a UV tape 22. In place of the UV tape, a thermal release tape may be used. This fixation can prevent warpage of the TFC substrate 21. Then, a metal-magnetic-powder-containing resin paste 15*p* is screen-printed on a top surface side of the TFC substrate 21 to which the UV tape 22 is not attached. Although not especially limited, a thickness of a screen sheet is about 0.27 mm. After the screen printing, defoaming is performed, and then heating is performed at a temperature of 80° C. for 30 minutes, to temporarily cure the resin paste.

Figure 6A:
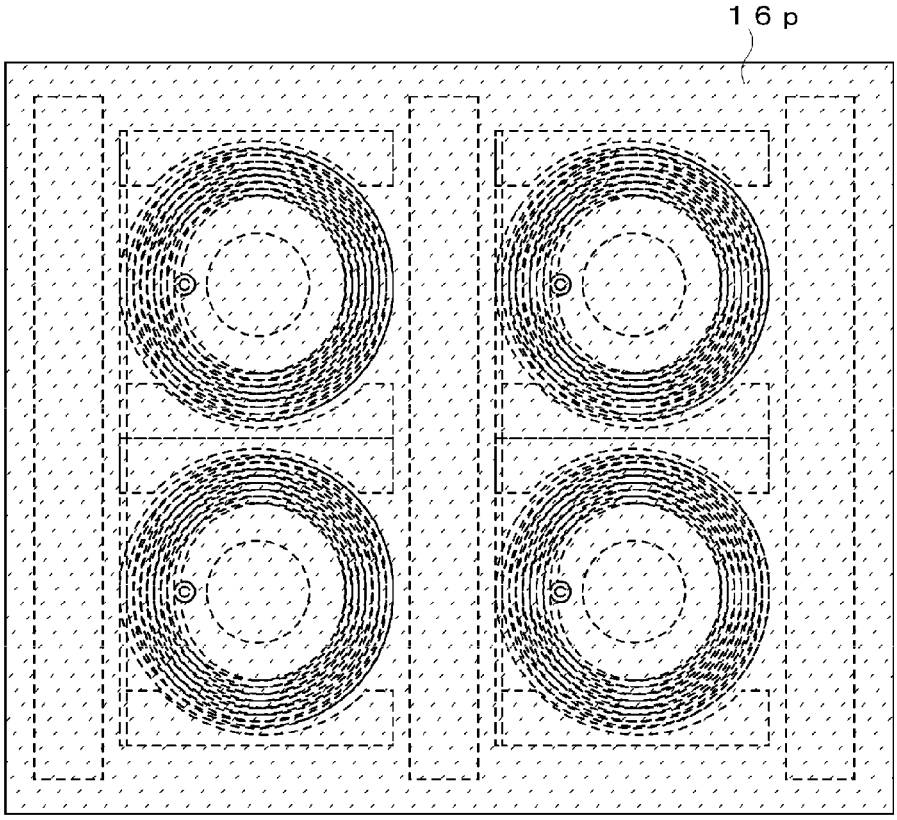
Figure 6B:
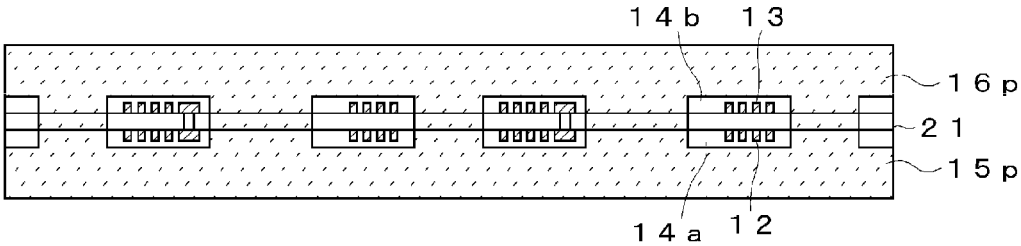

Subsequently, as illustrated in FIGS. 6A and 6B, the TFC substrate 21 is turned upside down, the UV tape 22 is removed from the TFC substrate 21, and a metal-magnetic-powder-containing resin paste 16*p* is screen-printed on the back surface side of the TFC substrate 21. A thickness of a screen sheet to be used at this time is also 0.27 mm. Thereafter, heating is performed at a temperature of 160° C. for one hour to fully cure the resin pastes 15*p* and 16*p*. As a result, the upper and lower cores 15 and 16 are obtained.

Figure 7A:
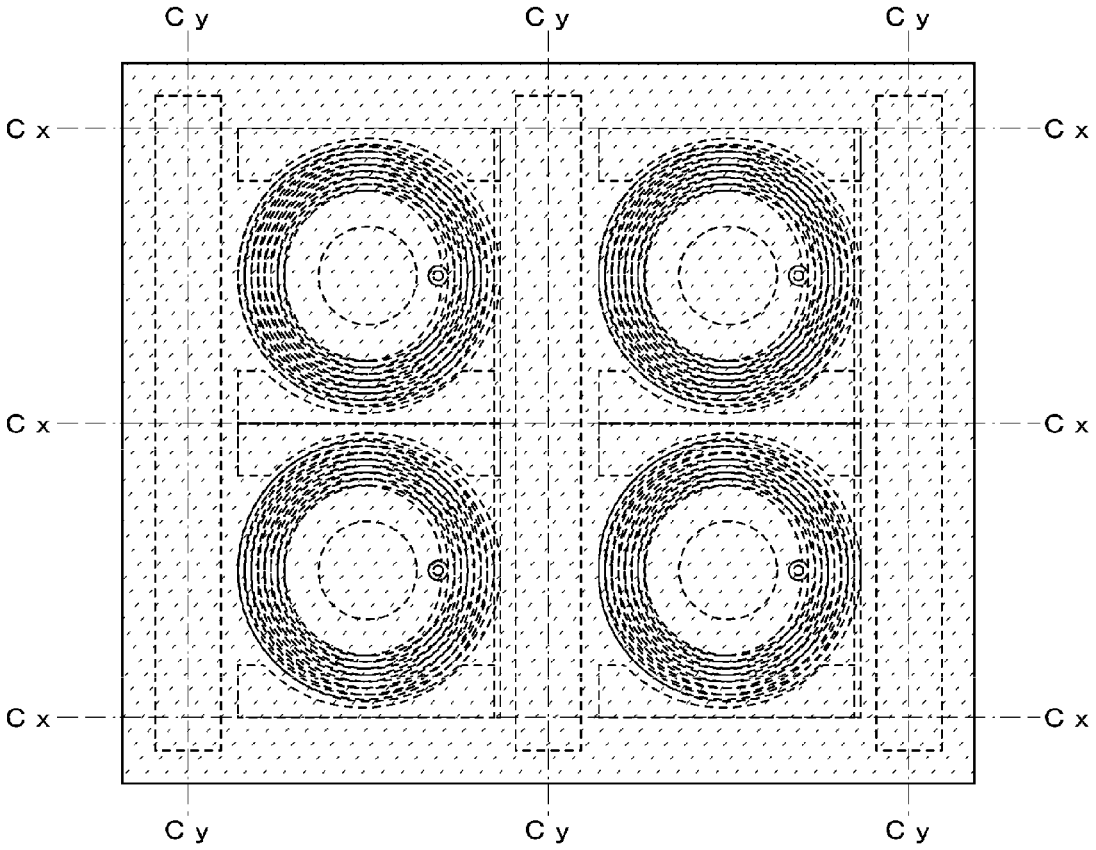
Figure 7B:
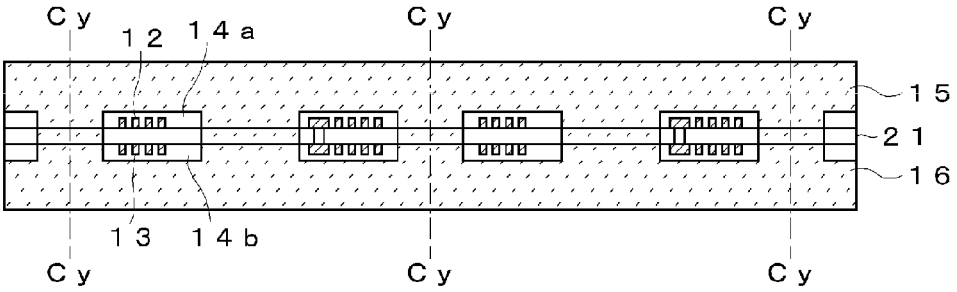

Subsequently, as illustrated in FIGS. 7A and 7B, the TFC substrate 21 is diced along cutting lines Cx and Cy to divide a coil assembly into pieces. Thereafter, the insulating film 19 is formed on the surfaces of the upper and lower cores 15 and 16, and the terminal electrodes 17*a* and 17*b* are formed on the side surfaces of the individual chips, whereby the coil component 10 according to the present embodiment is obtained.

As described above, the coil component 10 according to the present embodiment, in which the magnetic body covering the first and second spiral conductors 12 and 13 is resin-molded, has a very high dimension processing accuracy. Further, since a plurality of the coil components are formed as an assembly on the substrate surface, coil position accuracy is significantly high, and a reduction in size and thickness is allowed. The magnetic body, which is formed of the metal magnetic material, has more excellent DC superimposition characteristics than the ferrite, thus eliminating the need to form a magnetic gap.

Figure 8:
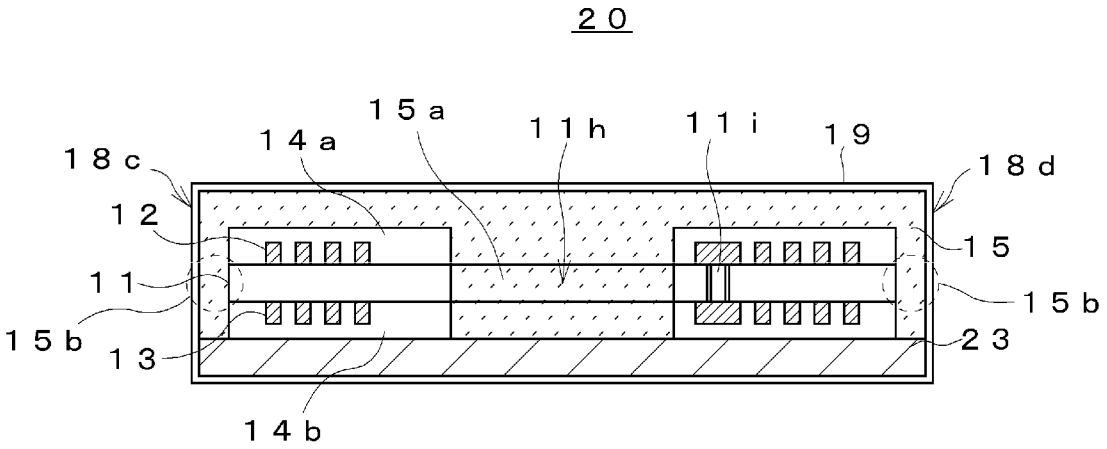
FIG. 8 is a schematic side cross-sectional view illustrating a structure of a coil component 20 according to a second embodiment of the present invention.

FIG. 8 is a schematic side cross-sectional view illustrating a structure of a coil component 20 according to a second embodiment of the present invention.

As illustrated in FIG. 8, the coil component 20 according to the second embodiment is characterized by that a lower core 23 is constituted by a ferrite substrate. The material of the upper core 15 is the metal-magnetic-powder-containing resin as in the case of the coil component 10 of the first embodiment. As described above, in the present embodiment, different materials are used to form the upper and lower cores 15 and 23, so that, unlike the first embodiment, the boundary between the upper and lower cores 15 and 23 is clear, and the upper and lower cores 15 and 23 are configured to be an E-type core and an I-type core, respectively. Other configurations are substantially the same as those of the coil component 10 of the first embodiment, so the same reference numerals are given to the same parts, and the repeated description will be omitted.

In the manufacturing process of the coil component 20, the TFC substrate 21 illustrated in FIGS. 4A and 4B is first produced, and then the insulating resin layers 14*a* and 14*b* are formed on the both surfaces of the TFC substrate 21. After that, the resultant TFC substrate 21 is mounted on a ferrite substrate having a size equivalent to the TFC substrate 21, and then screen printing of the metal-magnetic-powder-containing resin paste is performed on the ferrite substrate. The use of the ferrite substrate eliminates the need to use the UV tape 22. After the screen printing, defoaming is performed, and then heating is performed at a temperature of 160° C. for one hour, to fully cure the resin paste. As a result, the coil component 20 according to the present embodiment is obtained.

As described above, in the coil component 20 according to the present embodiment, the metal-magnetic-powder-containing resin is used to form the upper core 15, so that the same effects as those of the coil component 10 according to the first embodiment can be achieved. Further, the ferrite substrate can be used as a support substrate at a time of formation of the resin paste, thus eliminating the need to use the UV tape 22, facilitating the manufacturing process of the coil component 20.

Figure 9:
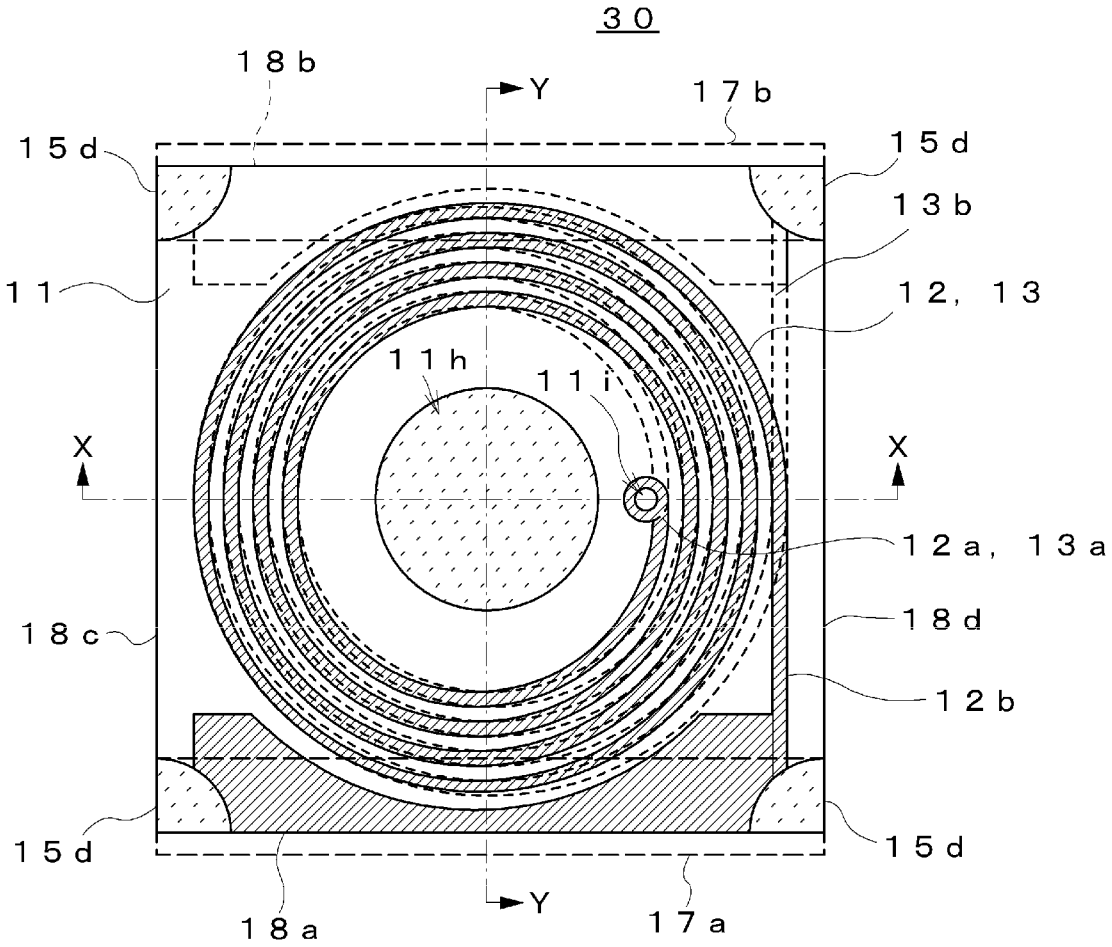
FIG. 9 is a schematic plan view illustrating a structure of a coil component 30 according to a third embodiment of the present invention.

FIG. 9 is a schematic plan view illustrating a structure of a coil component 30 according to a third embodiment of the present invention.

As illustrated in FIG. 9, the coil component 30 according to the third embodiment is characterized by that the upper and lower cores 15 and 16 are connected to each other through connecting portions 15*d* provided at respective four outside corners of the insulting substrate 11. That is, the connecting portions 15*d* each formed of the metal-magnetic-powder-containing resin are formed not in the entire width direction of respective side surfaces 18*a* to 18*d* of the laminated body but only at end portions in the width direction. The connection portions 15*d* at the four corners each adjoin an edge of the corner portion of the insulating substrate 11 and has a quarter-round shape as viewed from the above. Other configurations are substantially the same as those of the coil component 10 of the first embodiment, so the same reference numerals are given to the same parts, and the repeated description will be omitted.

In the present embodiment, the material of the lower core 16 is not especially limited as long as the connecting portions 15*d* are each formed of the metal-magnetic-powder-containing resin. Thus, the material of the lower core 16 may be the metal-magnetic-powder-containing resin or ferrite substrate. In either case, the upper and lower cores 15 and 16 are completely connected to each other at the four corners of the insulating substrate 11, so that a closed magnetic path having no gap can be formed as in the case of the first embodiment. Further, in the present embodiment, formation of the closed magnetic paths at the four corners results in an increase in an area for forming the spiral conductors 12 and 13, thereby increasing a loop size. This can achieve a low coil resistance, a high inductance, and a reduction in size.

Figure 10:
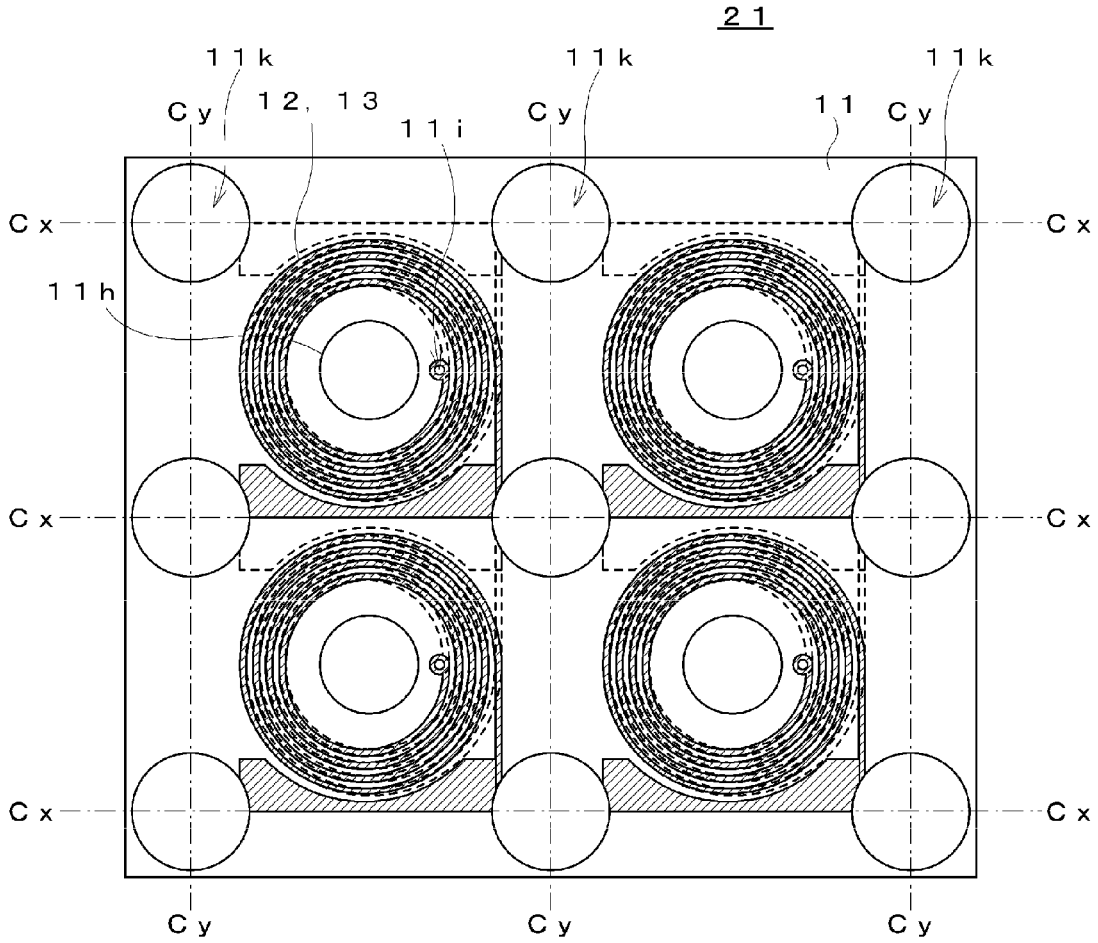
FIG. 10 is a schematic plan view illustrating a manufacturing process of the coil component 30.

FIG. 10 is a schematic plan view illustrating a manufacturing process of the coil component 30.

In the manufacturing process of the coil component 30, the TFC substrate 21 is first produced. A production method of the TFC substrate 21 is the same as that for the coil component 10 according to the first embodiment except that, as illustrated in FIG. 10, opening patterns 11*k* each having substantially a circular shape are formed at positions corresponding to the four corners of each of the insulating substrates obtained after cutting as substitute for the slits 11*g* shown in FIG. 4A. The subsequent processing steps are the same as those in the manufacturing process of the coil component 10. That is, the metal-magnetic-powder-containing resin is formed on the both surfaces of the TFC substrate 21, and the metal-magnetic-powder-containing resin is embedded in the openings 11*h*, as well as, in the openings 11*k* (see FIGS. 5 and 6). Thereafter, the TFC substrate 21 is cut along the cutting lines Cx and Cy intersecting each other at a center of each of the openings 11*k*, followed by formation of the terminal electrodes 17*a* and 17*b*, whereby the coil component 13 is obtained.

Figure 11:
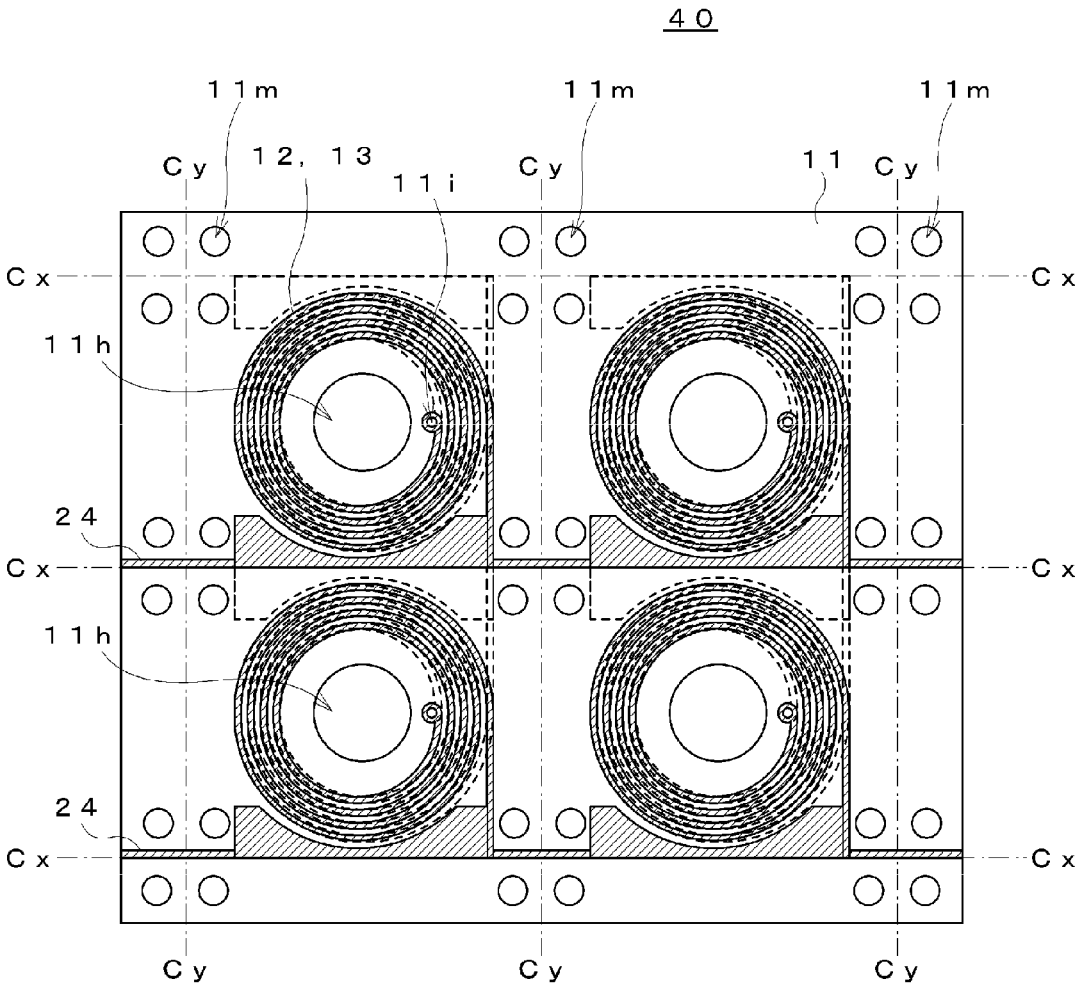
FIG. 11 is a schematic plan view illustrating a structure of a coil component according to a fourth embodiment of the present invention.

FIG. 11 is a schematic plan view illustrating a structure of a coil component according to a fourth embodiment of the present invention.

As illustrated in FIG. 11, a coil component 40 according to the fourth embodiment is characterized by that it is the same as the coil component 30 of the third embodiment in that the upper and lower cores 15 and 16 are connected to each other through the connecting portions provided at the respective outside four corners of the insulating substrate 11 but differs therefrom in that the connecting portions are formed not based on the opening patterns 11*k* shared between the adjacent four coil components, but based on openings 11*m* formed independently for each coil component.

Further, a plating conductor pattern 24 for short-circuiting conductor patterns of adjacent chips in the mass production process is provided in the coil component 40. The conductor pattern 24 is provided for allowing voltage to be simultaneously applied to all the conductor patterns during electroplating in the mass production. For example, in the coil component 30 according to the third embodiment illustrated FIGS. 9 and 10, spiral conductors of the chips adjacently disposed in a left-right direction are electrically isolated, and accordingly, the electroplating cannot be conducted therefor at a time. However, in case where the independent openings 11*k* are formed at the four corners and the independent connecting portions are formed based on the openings 11*k*, it is possible to layout the conductor pattern 24 extending in the left-right direction easily, thereby allowing plating processing to be applied at a time to the conductor patterns of the plurality of chips disposed adjacently in the left-right direction, which can make the manufacturing process efficient.

In a state of a finished article (in an individual chip obtained by cutting the insulating substrate), one end of the plating conductor pattern 24 is electrically connected to the spiral conductor 12 (or spiral conductor 13), and the other end thereof extends up to the edge of the insulating substrate 11 to be an open end. The conductor pattern 24 need not always be formed at the edge of the insulating substrate 11, but may be formed at an arbitrary position. In that case, the conductor pattern 24 can be formed in, for example, the coil component 30 according to the third embodiment.

Figure 12A:
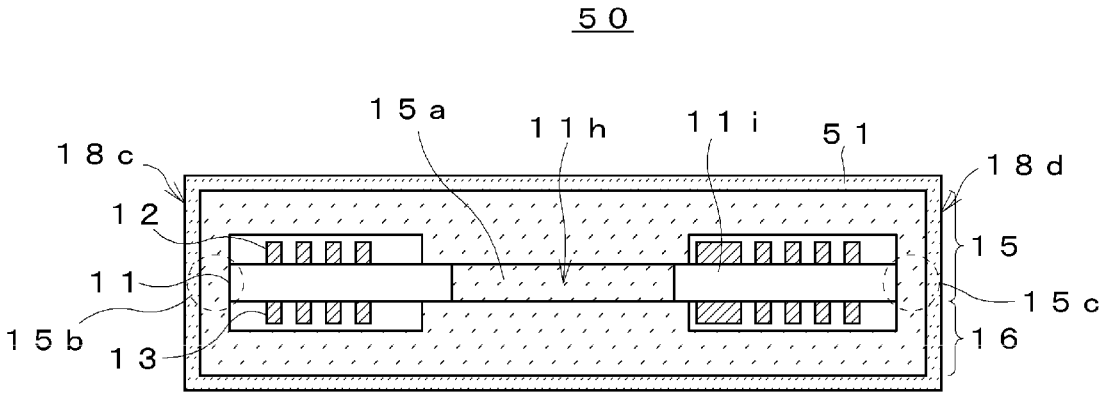
FIGS. 12A and 12B are schematic plan views illustrating a structure of a coil component according to a fifth embodiment of the present invention.
Figure 12B:
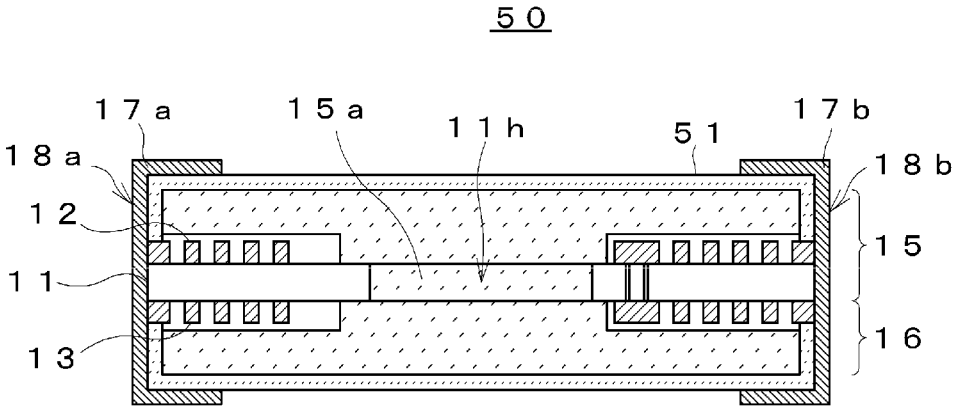

FIGS. 12A and 12B are schematic side cross-sectional views each illustrating a structure of a coil component according to a fifth embodiment of the present invention. FIG. 12A corresponds to FIG. 3A, and FIG. 12B corresponds to FIG. 3B.

As illustrated in FIG. 12, a coil component 50 according to the fifth embodiment is characterized by that an insulating film 51 formed of an Ni-based-ferrite-containing resin is formed on the surface (exposed surface) of the metal-magnetic-powder-containing resin constituting the upper and lower cores 15 and 16. Although not especially limited, a thickness of the insulating film 51 is about 50 μm. The insulating film 51 formed of the Ni-based-ferrite-containing resin functions not only as the insulating film but also as apart of the closed magnetic path together with the metal-magnetic-powder-containing resin.

When the metal-magnetic-powder-containing resin is used as a magnetic core for constituting the closed magnetic path as described above, an insulating property between the terminal electrodes 17*a* and 17*b* becomes an issue because the metal magnetic powder is a conductor. However, according to the present embodiment, the surface of the metal-magnetic-powder-containing resin is insulating-coated, so that it is possible to ensure a sufficient insulating property between the terminal electrodes 17*a* and 17*b*. Further, in the coil component 10 according to the first embodiment, the surfaces of the upper and lower cores 15 and 16 are insulating-coated by the chemical conversion treatment; however, the insulating coating part does not function as the closed magnetic path. According the present invention, it is possible to allow the insulating film to function as part of the closed magnetic path while ensuring the insulating property, which can in turn improve inductance characteristics.

Figure 13A:
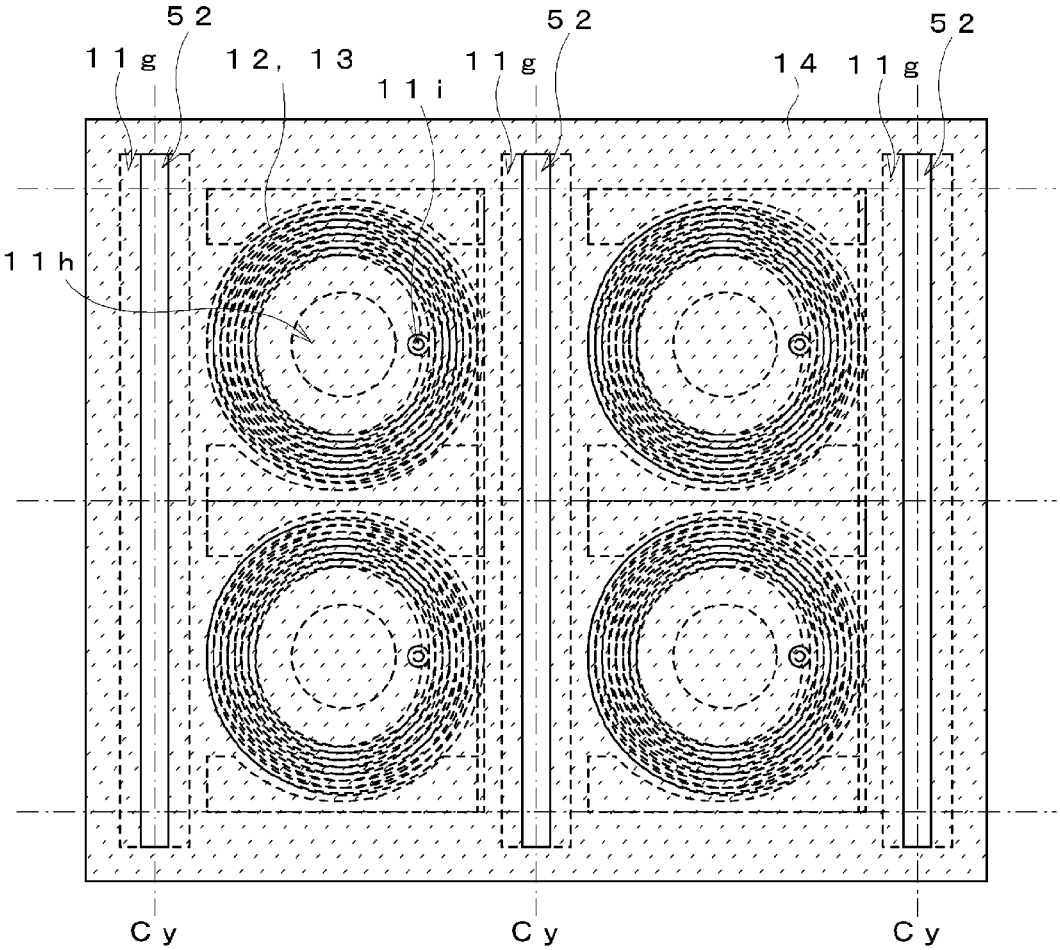
Figure 13B:
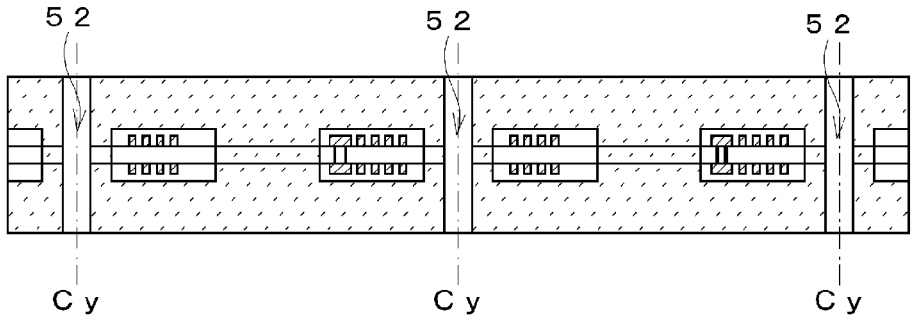

In the manufacturing process of the coil component 50, the metal-magnetic-powder-containing resin is formed on the both surfaces of the TFC substrate 21 (see FIGS. 6A and 6B). Then, as illustrated in FIGS. 13A and 13B, a slit 52 is formed at a width direction center portion of the slit 11*g* in which the metal-magnetic-powder-containing resin has been embedded. A blade width at a time of formation of the slit 52 is set to, e.g., 100 μm.

Figure 14:
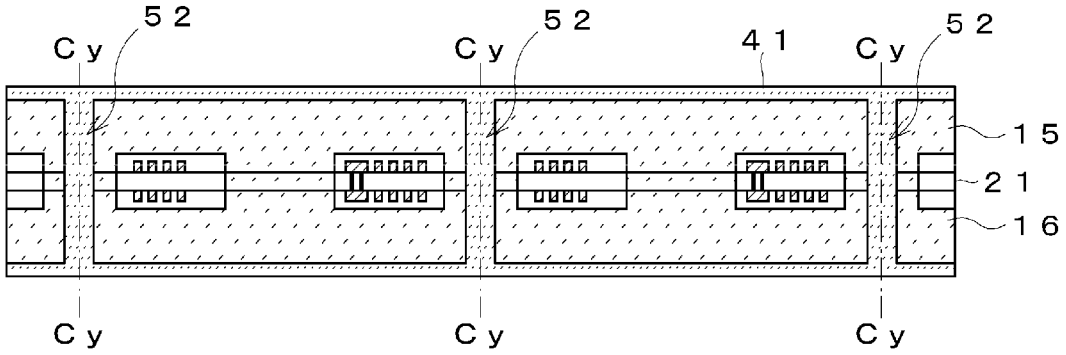
FIG. 14 is a schematic side cross-sectional view illustrating a manufacturing process of the coil component 50.

Then, as illustrated in FIG. 14, an Ni-based-ferrite-containing resin paste is screen-printed on the entire substrate surface including an inside of the slit 52 and is then fully cured. Because the resin paste is introduced inside the slit 52, too, the resin paste is formed not only on the upper and lower surfaces of the TFC substrate 21 on which the upper and lower cores 15 and 16 are formed, respectively, but also on side surfaces thereof.

Subsequently, the TFC substrate 21 is diced along the cutting lines Cx and Cy to divide a coil assembly into pieces (see FIGS. 7A and 7B). The blade width at this time is, e.g., 50 μm, which is narrower than that at the slit formation time, so that it is possible to partially leave the Ni-based-ferrite-containing resin. Thereafter, the pair of terminal electrodes 17*a* and 17*b* are formed on the side surfaces of each chip, whereby the coil component 50 in which not only the upper and lower surface of the magnetic core, but also the side surfaces thereof are coated with the insulating film 51 formed of the Ni-based-ferrite-containing resin is obtained.

FIG. 15 is a schematic side cross-sectional view illustrating a structure of a coil component 60 according to a sixth embodiment of the present invention.

As illustrated in FIG. 15, the coil component 60 according to the sixth embodiment is characterized by that it includes two laminated insulating substrates 11A and 11B. The number of laminated substrates is not limited to two, but may be three or more. The first and second spiral conductors 12 and 13 are formed on upper and lower surfaces of each of the insulating substrates 11A and 11B. Because the surfaces thereof are covered by the insulating resin layers 14*a* and 14*b*, respectively, and the metal-magnetic-powder-containing resin is not interjacent, the upper and lower conductors do not contact each other and are thus not short-circuited despite the insulating substrates 11A and 11B are laminated one over the other. The two laminated insulating substrates 11A and 11B may be bonded by bonding a surface of the insulating resin layer 14*a* covering the insulating substrate 11A and a surface of the insulating resin layer 14*b* covering the insulating substrate 11B with insulating adhesive. Other configurations are substantially the same as those of the coil component 10 of the first embodiment, so the same reference numerals are given to the same parts, and the repeated description will be omitted.

In the above structure, the metal-magnetic-powder-containing resin unintentionally exists between the insulating substrates 11A and 11B for manufacturing reasons. However, such a metal-magnetic-powder-containing resin does not adversely affect the insulating property. Thus, there is no problem unless the metal-magnetic-powder-containing resin exists in essence between the insulating substrates 11A and 11B.

The first and second spiral conductors 12 and 13 formed on the upper and lower surfaces of the insulating substrate 11A constitute a single coil, and the first and second spiral conductors 12 and 13 formed on the upper and lower surfaces of the insulating substrate 11B also constitute a single coil. The outer peripheral end 12*b* of the first spiral conductor 12 on the insulating substrate 11A and the outer peripheral end 12*b* of the first spiral conductor 12 on the insulating substrate 11B are electrically connected to each other through the first terminal electrode 17*a*, and the outer peripheral end 13*b* of the second spiral conductor 13 on the insulating substrate 11A and the outer peripheral end 13*b* of the second spiral conductor 13 on the insulating substrate 11B are electrically connected to each other through the second terminal electrode 17*b*, whereby the two coils are connected to each other in parallel. The parallel connection between the coils having the same structure corresponds to doubling of a sectional area of the coil conductor, so that it is possible to reduce the resistance of the coil to half, thereby allowing a reduction in the DC resistance.

Figure 16A:
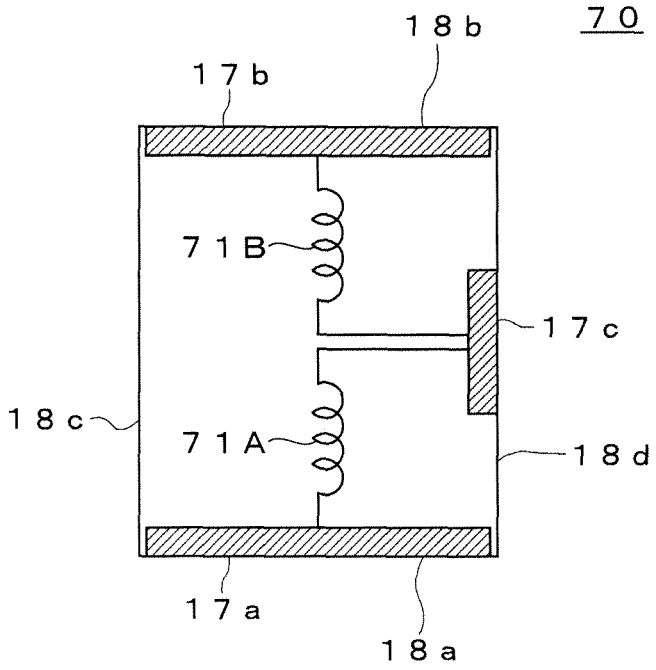
Figure 16B:
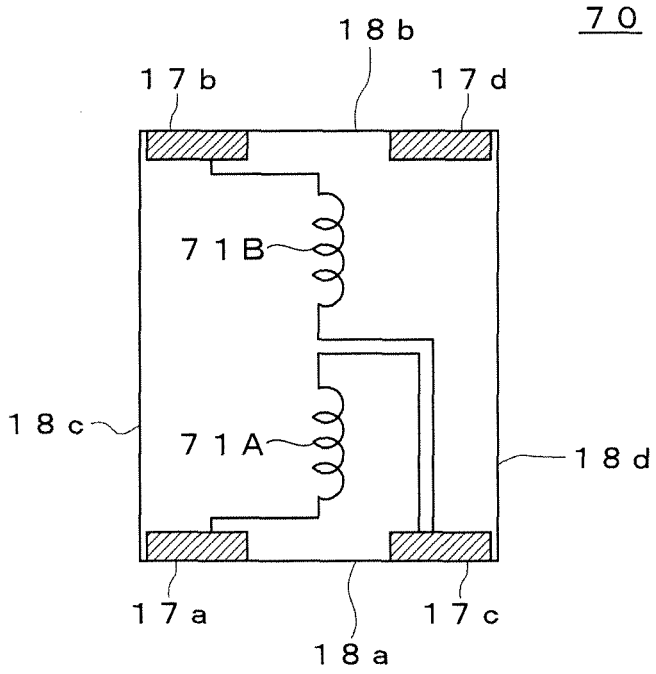

FIGS. 16A and 16B are schematic views each illustrating a structure of a coil component 70 according to a seventh embodiment of the present invention. In FIG. 16, the laminated structure and spiral structure of the coil component are omitted, and only an electrical configuration of the coil is illustrated in a simple manner.

As illustrated in FIGS. 16A and 16B, the coil component 70 according to the seventh embodiment is similar to the coil component 60 of the sixth embodiment in that it includes the two laminated insulating substrates 11A and 11B, a single coil (first coil) 71A constituted by the first and second spiral conductors 12 and 13 formed on the insulating substrate 11A, and a single coil (second coil) 71B constituted by the first and second spiral conductors 12 and 13 formed on the top and back surfaces of the insulating substrate 11B, but differs therefrom in that the coils 71A and 71B are connected not in parallel but in series.

The series connection between the first and second coils 71A and 71B needs to be made through an external terminal electrode. Thus, a terminal electrode 17*c* for series connection is provided in addition to the pair of terminal electrodes 17*a* and 17*b*. As illustrated in FIG. 16A, the terminal electrode 17*c* may be formed on one of two side surfaces (18*c* and 18*d*) different from two side surfaces 18*a* and 18*b* (see FIG. 2) on which the pair of terminal electrodes 17*a* and 17*b* are formed respectively. Alternatively, as illustrated in FIG. 16B, the terminal electrode 17*c* may be formed on one of the side surfaces 18*a* and 18*b*. In the case where the terminal electrode 17*c* is formed on one of the side surfaces 18*a* and 18*b*, widths of the pair of terminal electrodes 17*a* and 17*b* are reduced so as to achieve a four-terminal electrode structure with one of the four terminal electrodes used as a dummy electrode 17*d*.

In the case where the two insulating substrates 11A and 11B are used and where the single coils 71A and 71B formed respectively on the insulating substrates 11A and 11B are connected in series, the number of turns of the coil required in one substrate is reduced, thereby allowing an increase in a wire width of the spiral conductor. The increase in the wire width in turn allows an increase in plating thickness, which can sufficiently increase a sectional area of the spiral conductor and can thus reduce the DC resistance.

Although the first to seventh embodiments of the present invention are described above, the invention is not limited to the embodiments. Various modifications can be made without departing from the scope of the present invention, and obviously the modifications are included in the scope of the present invention.

For example, although the inner peripheral end 12*a* of the first spiral conductor 12 and inner peripheral end 13*a* of the second spiral conductor 13 are connected to each other through the through hole conductor 11*i* in the above first to seventh embodiments, the present invention is not limited to this. For example, the inner peripheral ends may be connected to each other through a conductor pattern formed in an inner peripheral surface of the opening 11*h* of the printed board.

Figure 17:
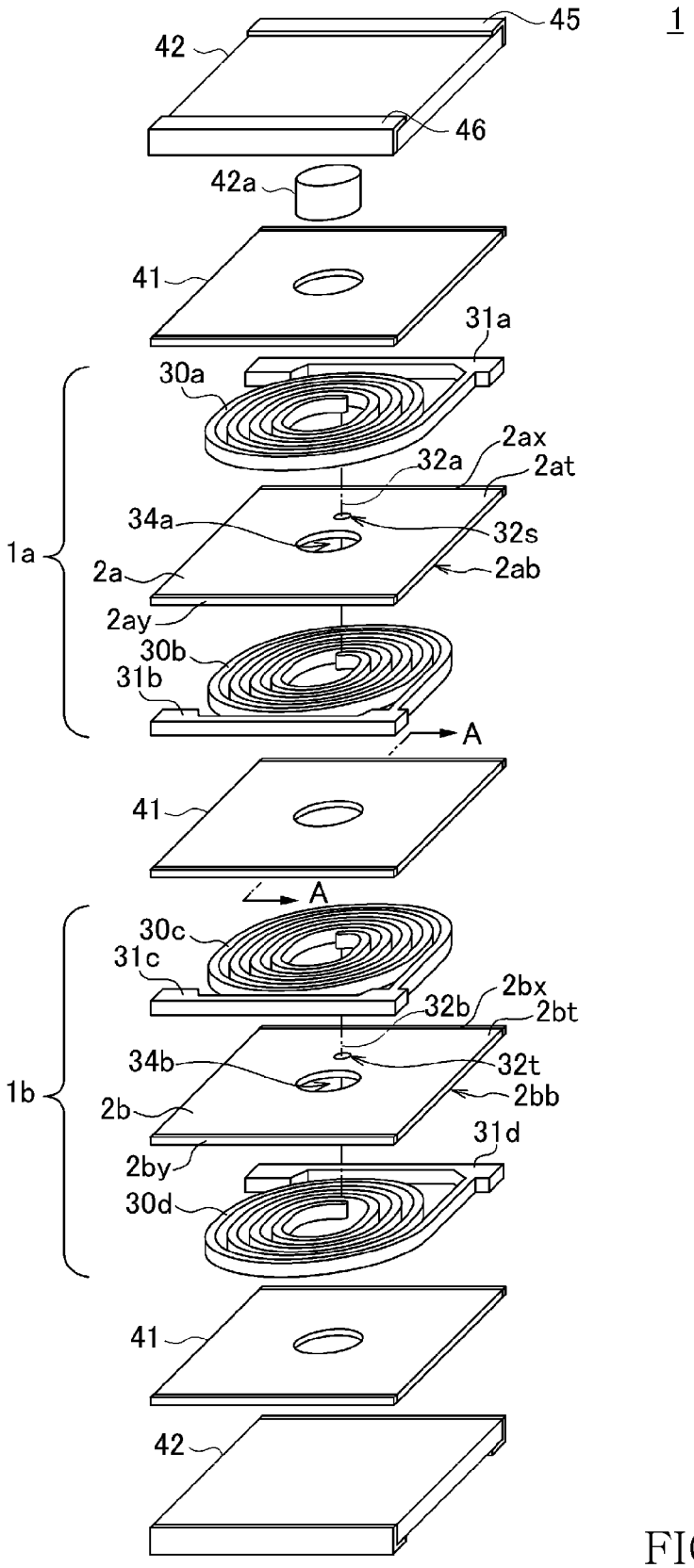
FIG. 17 is an exploded perspective view of a coil component according to an eighth embodiment of the present invention.
Figure 18:
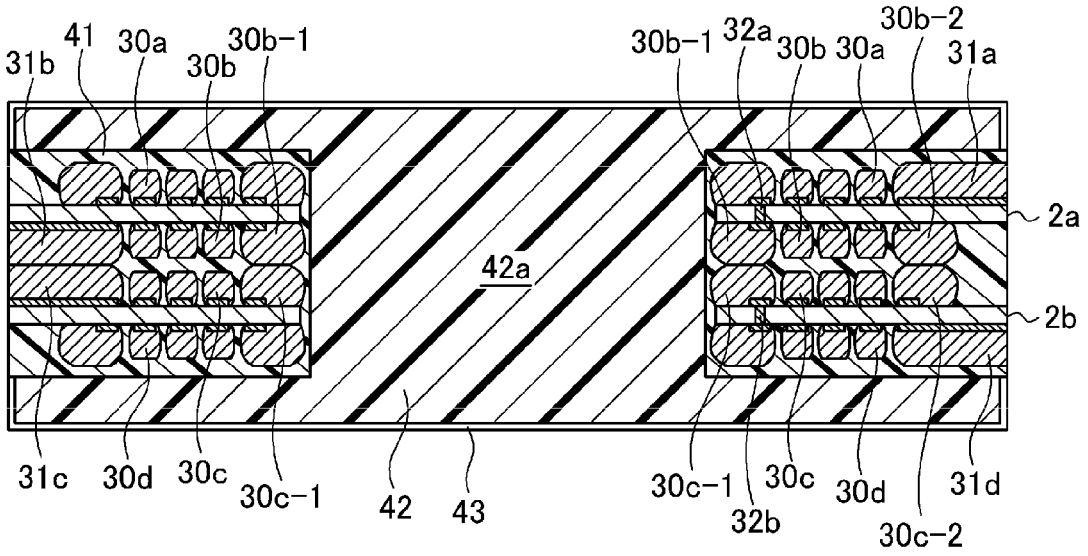
FIG. 18 is a cross-sectional view of the coil component taken along an A-A line of FIG. 17.
Figure 19:
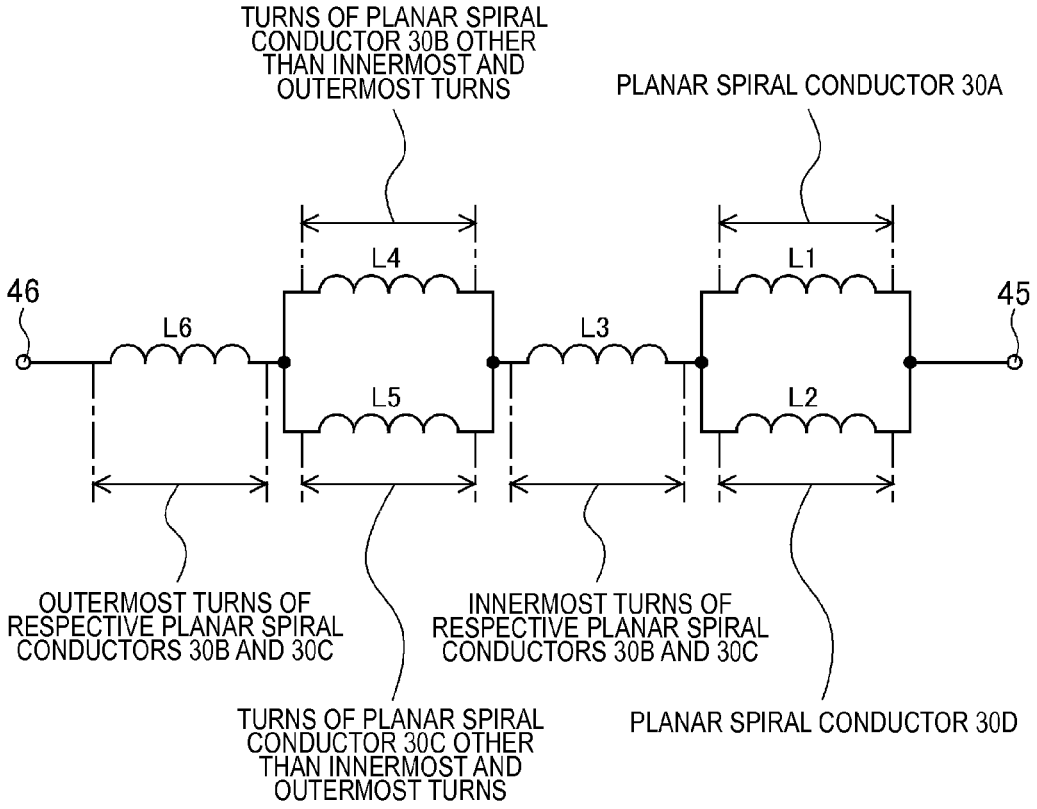
FIG. 19 is an equivalent circuit diagram of the coil component according to the eighth embodiment of the present invention.

FIG. 17 is an exploded perspective view of a coil component 1 according to an eighth embodiment of the present invention. As illustrated, the coil component 1 has a structure in which two basic coil components 1*a* and 1*b* are laminated one over the other. FIG. 18 is a cross-sectional view of the coil component 1 taken along an A-A line of FIG. 17, and FIG. 19 is an equivalent circuit diagram of the coil component 1.

As illustrated in FIG. 17, the basic coil components 1*a* and 1*b* have rectangular substrates 2*a* and 2*b* (first and second substrates), respectively. The "rectangular" shape includes not only a complete rectangular shape, but also a rectangular shape in which some corners are missing. In the present specification, a term "corner portion" of the rectangular is used. The "corner portions" for the rectangular in which some corners are missing means that "Corner portions" of the complete rectangular which is obtained in case all corners are not missing. The basic coil components 1*a* and 1*b* are laminated one over the other such that a back surface 2*ab* of the substrate 2*a* and a top surface 2*bt* of the substrate 2*b* face each other.

As a material of each of the substrates 2*a* and 2*b*, a common printed board which is obtained by impregnating a glass fiber cloth with an epoxy resin is preferably used. Further, for example, a BT resin base material, an FR4 base material, an FR5 base material may be used.

A planar spiral conductor 30*a* (first planar spiral conductor) is formed at a center portion of a top surface 2*at* of the substrate 2*a*. Similarly, a planar spiral conductor 30*b* (second planar spiral conductor) is formed at a center portion of the back surface 2*ab*. A conductor-embedding through hole 32*s* (first through hole) is formed in the substrate 2*a*, and a through hole conductor 32*a* (first through hole conductor) is embedded inside the through hole 32*s*. An inner peripheral end of the planar spiral conductor 30*a* and an inner peripheral end of the planar spiral conductor 30*b* are connected to each other through the through hole conductor 32*a*.

A planar spiral conductor 30*c* (third planar spiral conductor) is formed at a center portion of the top surface 2*bt* of the substrate 2*b*. Similarly, a planar spiral conductor 30*d* (fourth planar spiral conductor) is formed at a center portion of a back surface 2*bb*. A conductor-embedding through hole 32*t* (second through hole) is formed also in the substrate 2*b*, and a through hole conductor 32*b* (second through hole conductor) is embedded inside the through hole 32*t*. An inner peripheral end of the planar spiral conductor 30*c* and an inner peripheral end of the planar spiral conductor 30*d* are connected to each other through the through hole conductor 32*b*.

The planar spiral conductor 30*a* and planar spiral conductor 30*b* are wound in opposite directions to each other. That is, the planar spiral conductor 30*a* is wound in a counterclockwise direction from its inner peripheral end to outer peripheral end as viewed from the top surface 2*at* side, and the planar spiral conductor 30*b* is wound in a clockwise direction from its inner peripheral end to outer peripheral end as viewed from also the top surface 2*at* side. With such a configuration, when current is made to flow between the outer peripheral end of the planar spiral conductor 30*a* and outer peripheral end of the planar spiral conductor 30*b*, both the planar spiral conductors generate magnetic fields of the same direction to reinforce one another. Thus, the basic coil component 1*a* functions as one inductor.

The same can be said for the planar spiral conductors 30*c* and 30*d*. However, the planar spiral conductor 30*c* has the same planar shape as that of the planar spiral conductor 30*b* as viewed from the top surface 2*at* side, and planar spiral conductor 30*d* has the same planar shape as that of the planar spiral conductor 30*a* as viewed from also the top surface 2*at* side. That is, the basic coil component 1*a* and basic coil component 1*b* have vertically inverted shapes.

Lead-out conductors 31*a* and 31*b* are formed on the top surface 2*at* and back surface 2*ab* of the substrate 2*a*, respectively. The lead-out conductor 31*a* (first lead-out conductor) is formed along a side surface 2*ax* of the substrate 2*a*. The lead-out conductor 31*b* (second lead-out conductor) is formed along a side surface 2*ay* opposite to the side surface 2*ax*. The lead-out conductor 31*a* is connected to the outer peripheral end of the planar spiral conductor 30*a*, and the lead-out conductor 31*b* is connected to the outer peripheral end of the planar spiral conductor 30*b*.

Similarly, Lead-out conductors 31*c* and 31*d* are formed on the top surface 2*bt* and back surface 2*bb* of the substrate 2*b*, respectively. The lead-out conductor 31*c* (third lead-out conductor) is formed along a side surface 2*by* of the substrate 2*b*. The side surface 2*by* is a side surface on the same side as the side surface 2*ay* of the substrate 2*a*. The lead-out conductor 31*d* (fourth lead-out conductor) is formed along a side surface 2*bx* opposite to the side surface 2*by*. The side surface 2*bx* is a side surface on the same side as the side surface 2*ax* of the substrate 2*a*. The lead-out conductor 31*c* is connected to the outer peripheral end of the planar spiral conductor 30*c*, and the lead-out conductor 31*d* is connected to the outer peripheral end of the planar spiral conductor 30*d*.

The planar spiral conductors 30*a* to 30*d* and lead-out conductors 31*a* to 31*d* are each obtained by forming a base layer through an electroless plating process and then by performing a electrolytic plating process two times. Both materials of the base layer and a plated layer formed in the two electrolytic plating processes are preferably Cu. The plated layer formed in the first electrolytic plating process serves as a seed layer in the second electrolytic plating process. This will be described in detail layer.

As illustrated in FIGS. 17 and 18, the planar spiral conductors 30*a* to 30*d* and lead-out conductors 31*a* to 31*d* are covered by an insulating resin layer 41. The insulating resin layer 41 is provided for preventing the conductors and a metal-magnetic-powder-containing resin layer 42 to be described later from being electrically conductive. In the present embodiment, the insulating resin layer 41 functions also as an insulating layer for electrically isolating between the basic coil component 1*a* (specifically, the planar spiral conductor 30*b* and lead-out conductor 31*b*) and basic coil component 1*b* (specifically, the planar spiral conductor 30*c* and lead-out conductor 31*c*). That is, the insulating resin layer 41 is also formed between the basic coil component 1*a* (specifically, the planar spiral conductor 30*b* and lead-out conductor 31*b*) and basic coil component 1*b* (specifically, the planar spiral conductor 30*c* and lead-out conductor 31*c*) to electrically isolate them from each other. However, in the present embodiment, the electrical isolation is effected only at a part of the turn of the planar spiral conductor, not the entire turn thereof. Specifically, as illustrated in FIG. 18, the insulating resin layer 41 is not provided between a top surface of an innermost turn 30*b*-1 of the planar spiral conductor 30*b* and a top surface of an innermost turn 30*c*-1 of the planar spiral conductor 30*c*, between a top surface of an outermost turn 30*b*-2 of the planar spiral conductor 30*b* and a top surface of an outermost turn 30*c*-2 of the planar spiral conductor 30*c*, and between a top surface of the lead-out conductor 31*b* and a top surface of the lead-out conductor 31*c*, and a physical contact and an electrical conduction are established therebetween. This point will be described later in detail again.

The top surface 2*at* of the substrate 2*a* and the back surface 2*bb* of the substrate 2*b* which are covered by the insulating resin layer 41 are further covered by a metal-magnetic-powder-containing resin layer 42. The metal-magnetic-powder-containing resin layer 42 are formed of a magnetic material (metal-magnetic-powder-containing resin) obtained by mixing metal magnetic particles with a resin. As the metal magnetic powder, a permalloy-based material is preferably used. Specifically, it is preferable to use metal magnetic powder obtained by mixing a Pb—Ni—Co alloy having an average particle diameter of 20 μm to 50 μm and carbonyl iron having an average particle diameter of 3 μm to 10 μm at a predetermined weight ratio of 70:30 to 80:20, preferably, 75:25. A content percentage of the metal magnetic powder in the metal-magnetic-powder-containing resin layer 42 is preferably 90% by weight to 96% by weight. Alternatively, the content percentage of the metal magnetic powder in the metal-magnetic-powder-containing resin layer 42 may be 96% by weight to 98% by weight. As a material for the resin, a liquid epoxy resin or a powder epoxy resin is preferably used. A content percentage of the resin in the metal-magnetic-powder-containing resin layer 42 is preferably 4% by weight to 10% by weight. The resin functions as an insulating binder. In the metal-magnetic-powder-containing resin layer 42 having the above configuration, the smaller an amount of the metal magnetic powder relative to the resin is, the lower the saturation flux density and, conversely, the larger the amount of the metal magnetic powder relative to the resin is, the higher the saturation flux density.

As illustrated in FIGS. 17 and 18, through holes 34*a* and 34*b* (through hole for forming a pangenetic path) are formed in the substrates 2*a* and 2*b*, respectively, so as to penetrate a portion thereof corresponding to a center portion of each of the planar spiral conductors. The metal-magnetic-powder-containing resin layer 42 is embedded also in the through holes 34*a* and 34*b*, and the embedded metal-magnetic-powder-containing resin layer 42 constitutes a through hole magnetic body 42*a*.

Further, as illustrated in FIG. 18, a thin insulating layer 43 is formed on a surface of the metal-magnetic-powder-containing resin layer 42. In FIG. 17, an illustration of the insulating layer 43 is omitted. The insulating layer 43 is formed by treating the surface of the metal-magnetic-powder-containing resin layer 42 with phosphate. Formation of the insulating layer 43 prevents an electrical conduction between external electrodes 45 and 46 to be described later and the metal-magnetic-powder-containing resin layer 42.

As illustrated in FIG. 17, external electrodes 45 and 46 (first and second external electrodes) are formed on side surfaces of the coil component 1. The external electrode 45 contacts the lead-out conductors 31*a* and 31*d* exposed to the side surfaces to be electrically conductive therewith. The external electrode 46 contacts the lead-out conductors 31*b* and 31*c* exposed to the side surfaces to be electrically conductive therewith. As illustrated in FIG. 17, the external electrodes 45 and 46 each preferably have a shape that covers the entire exposed surface of each of the lead-out conductors 31*a* and 31*b* and extends to upper and lower surfaces of the coil component 1. The external electrodes 45 and 46 are bonded to wires formed on a mounting substrate (not illustrated) by soldering, etc.

FIG. 19 is an equivalent circuit diagram of a circuit realized by the coil component 1 having the above configuration. As illustrated, according to the coil component 1 of the present embodiment, there are inserted between the external electrodes 45 and 46 an inductor L1 constituted by the planar spiral conductor 30*a*, an inductor L2 constituted by the planar spiral conductor 30*d*, an inductor L3 constituted by the innermost turns of the respective planar spiral conductors 30*b* and 30*c*, an inductor L4 constituted by turns of the planar spiral conductor 30*b* other than the innermost and outermost turns, an inductor L5 constituted by turns of the planar spiral conductor 30*c* other than the innermost and outermost turns, and an inductor L6 constituted by the outermost turns of the respective planar spiral conductors 30*b* and 30*c*. The inductors L1 and L6 are magnetically coupled to one another. The reason that the innermost turns of the respective planar spiral conductors 30*b* and 30*c* and the outermost turns thereof are each regarded as a single inductor is because they contact each other. As is clear from FIG. 19, according to the coil component 1, the DC resistance between the external electrodes 45 and 46 is reduced as compared with a case where a single basic coil component is used.

Functions and effects of the coil component 1 will be described in detail below.

Figure 20:
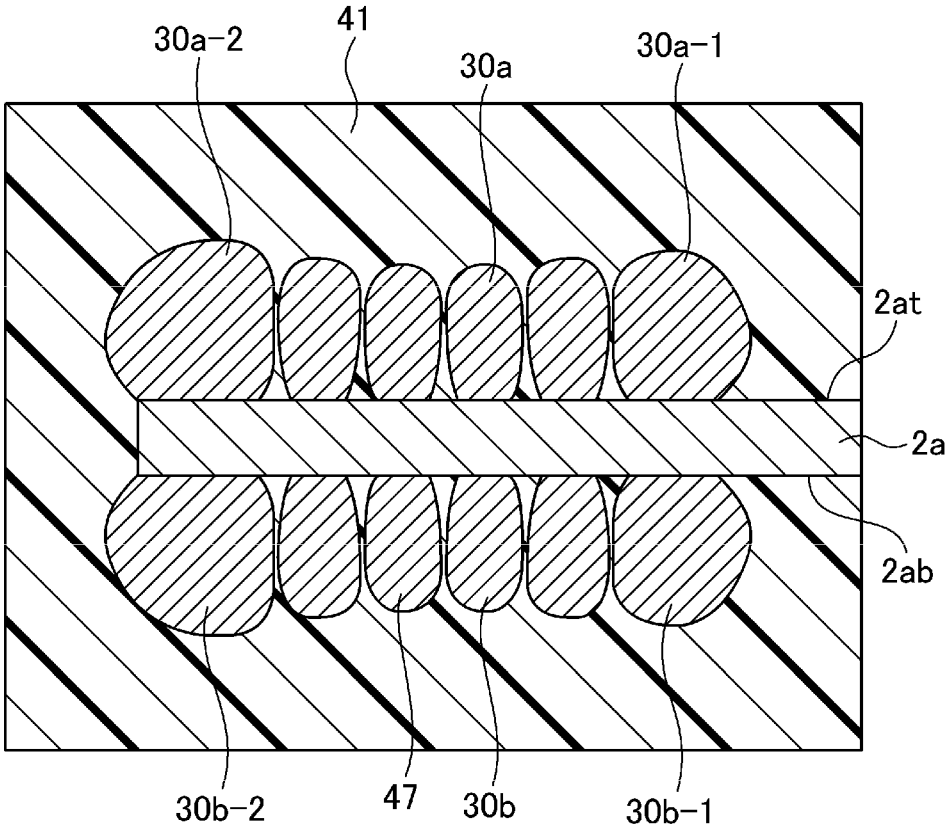
FIG. 20 is a trace of a cross-sectional electron microscope photograph of the planar spiral conductors after the second electrolytic plating process.

FIG. 20 is a trace of a cross-sectional electron microscope photograph of the planar spiral conductors 30*a* and 30*b* after the second electrolytic plating process. Although not illustrated, the same trace can be obtained from the planar spiral conductors 30*c* and 30*d*. A plating layer 47 illustrated in FIG. 20 is formed in the second electrolytic plating process. As illustrated, a wire width and a film thickness of each turn of the planar spiral conductors 30*a* and 30*b* after the second electrolytic plating process are roughly constant except for the innermost and outer most turns. On the other hand, the innermost and outermost turns each have a wire width and a film thickness larger than those of other turns. This is because the plated layer 47 grows large in a lateral direction and in a film thickness direction in the absence of the adjacent seed layer.

Figure 21A:
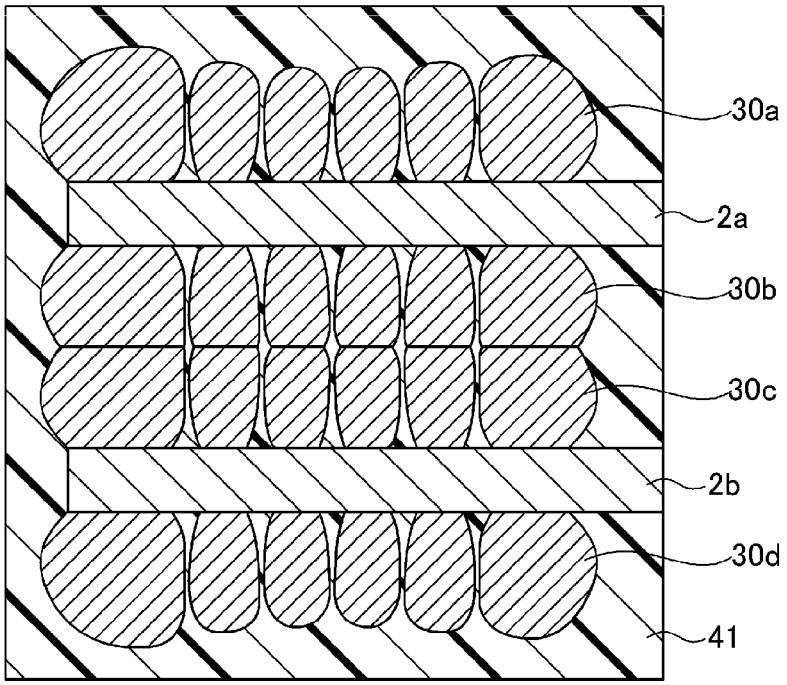
FIG. 21A illustrates a laminated state of the basic coil components which is considered ideal.

When the two basic coil components 1*a* and 1*b* are laminated one over the other for a reduction in the DC resistance, a distance between the two components is preferably as small as possible so as to strengthen the magnetic coupling between the planar spiral conductors for an increase in inductance and to reduce a height of the entire component. FIG. 21A illustrates a laminated state of the basic coil components 1*a* and 1*b* which is considered ideal in terms of the points described above. In this example, the top surfaces of the planar spiral conductors 30*b* and 30*c* are subjected to grinding to make the film thickness of each of the planar spiral conductors 30*b* and 30*c* uniform, and then the coil components 1*a* and 1*b* are laminated one over the other. If this is achieved, it is possible to minimize the distance between the basic coil components 1*a* and 1*b* while reducing the DC resistance.

Figure 21B:
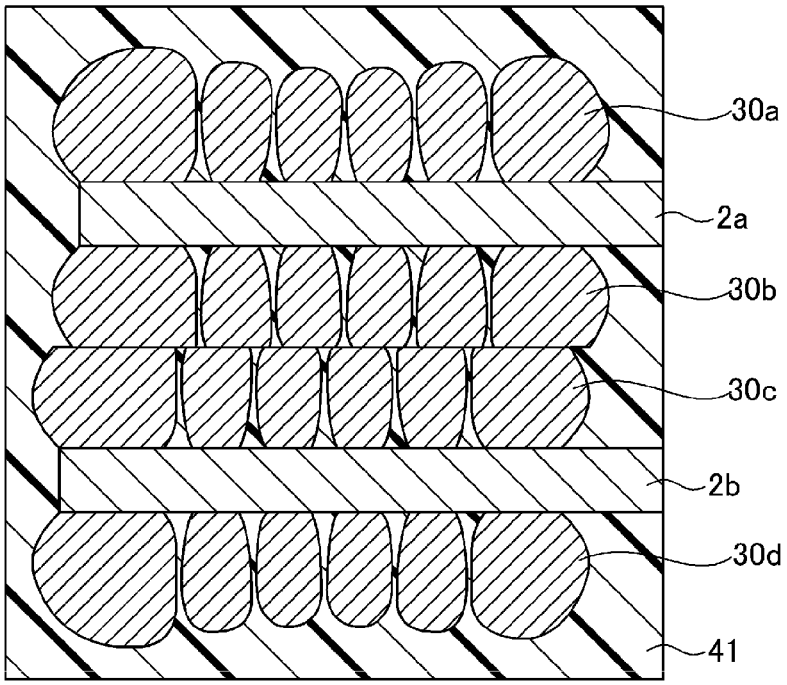
FIG. 21B illustrates a state where the coil-turn displacement has occurred between the basic coil components.

Actually, however, a coil-turn displacement inevitably occurs when the two basic coil components 1*a* and 1*b* are laminated one over the other, which makes it difficult to achieve the laminated state as illustrated in FIG. 21A. FIG. 21B illustrates a state where the coil-turn displacement has occurred between the basic coil components 1*a* and 1*b*. As illustrated, an occurrence of the coil-turn displacement causes a given turn of one of the planar spiral conductors 30*b* and 30*c* to contact a different turn of the other one thereof. This significantly degrades electrical and magnetic characteristics of the coil component 1, and therefore such a contact needs to be avoided.

Figure 22:
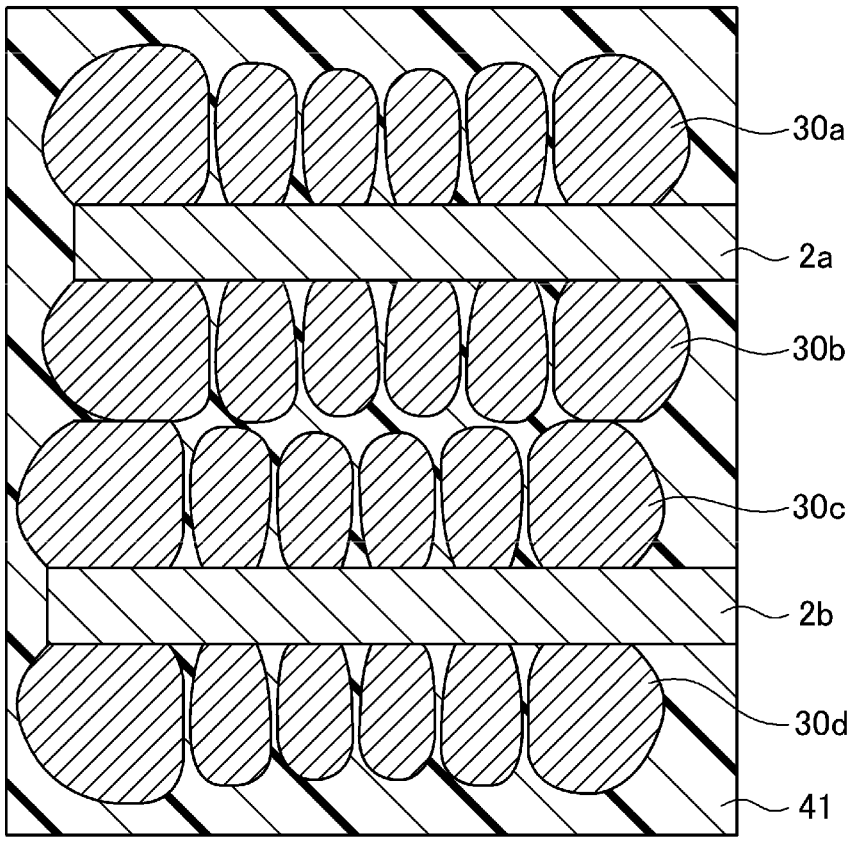
FIG. 22 illustrates a laminated state of the basic coil components according to the present embodiment.

In order to cope with this, as illustrated in FIG. 22, the top surfaces of portions (the innermost and outermost turns of each of the planar spiral conductors 30*b* and 30*c*, and lead-out conductors 31*b* and 31*c*) having relatively a large film thickness are brought into contact with each other after being slightly ground to be planarized. On the other hand, portions (the turns of the planar spiral conductor 30*b* other than the innermost and outermost turns, and turns of the planar spiral conductor 30*c* other than the innermost and outermost turns) having relatively a small film thickness are electrically isolated from each other by the insulating resin layer 41. This configuration is illustrated in FIG. 18. With this configuration, as illustrated in FIG. 22, even if the coil-turn displacement occurs, the contact between a given turn of one of the planar spiral conductors 30*b* and 30*c* and a different turn of the other one thereof does not occur. Thus, according to the coil component 1 of the present embodiment, it is possible to reduce to the extent possible the distance between the basic coil components 1*a* and 1*b* without causing the degradation in the electrical and magnetic characteristics.

Amass production process of the coil component 1 will be described. Although the following description is made first focusing on the basic coil component 1*a*, the same can be applied to the basic coil component 1*b*.

Figure 28:
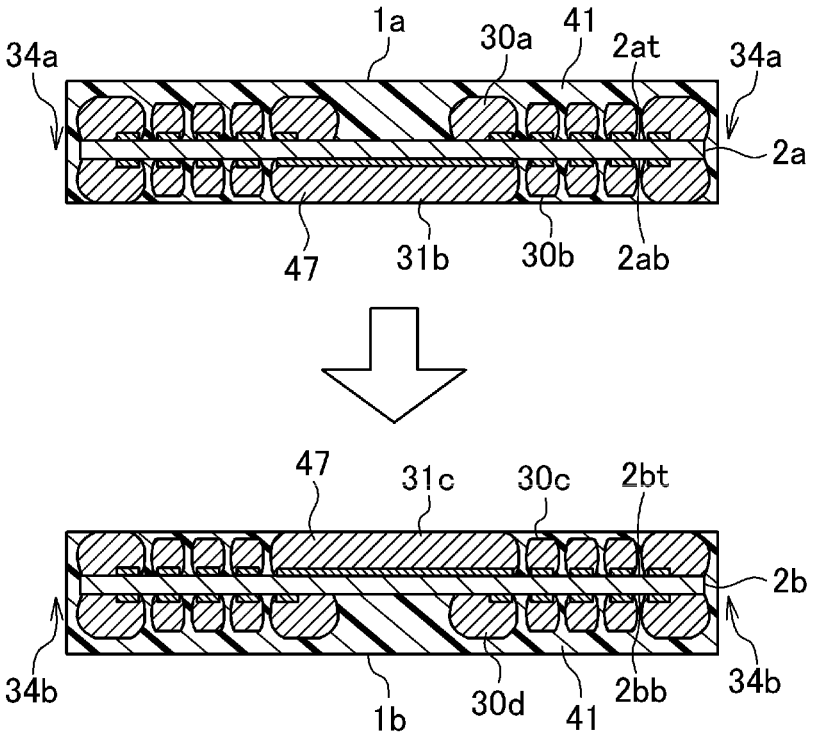
FIG. 28 is a view illustrating a process of laminating the basic coil components according to the eighth embodiment of the present invention.

FIGS. 23 to 27 are views illustrating the basic coil component 1*a* during the mass production process of the coil component 1. FIG. 28 is a view illustrating a process of laminating the basic coil components 1*a* and 1*b*. FIGS. 23A to 27A are each a plan view illustrating the substrate 2*a* before cutting as viewed from the top surface 2*at* side, and FIGS. 23B to 27B are each a cross-sectional view taken along a B-B line of the corresponding figure. Dashed lines shown in FIGS. 23A to 27A are cutting lines in a dicing process. Each rectangular area surrounded by the cutting lines (hereinafter, referred to merely as "rectangular area") becomes the individual basic coil component 1*a*.

Figure 23A:
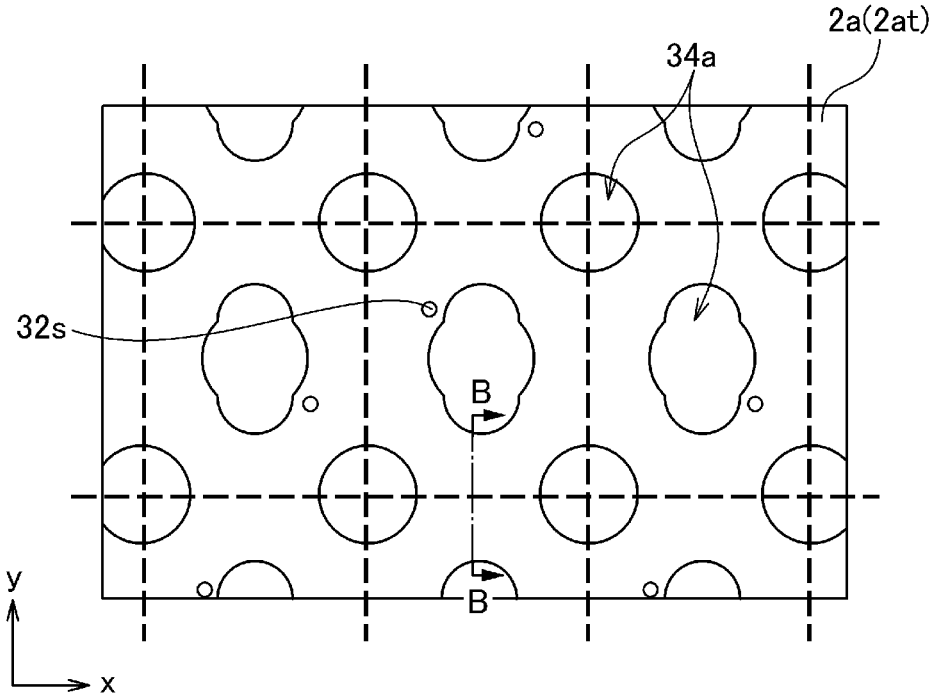

In the following description, the basic coil component 1*a* in which through holes 34*a* are formed at the four corner portions of the substrate 2*a* (substrate 2*a* after cutting) as illustrated in FIG. 23A is taken as an example. Such a configuration is adopted for the purpose of forming a complete closed magnetic path in the coil component 1, and the metal-magnetic-powder-containing resin layer 42 is embedded also in the through holes 34*a*. Although lengths of the lead-out conductors 31*a* and 31*b* along the side surface are reduced as compared to those of the example of FIG. 17 due to formation of the through holes 34*a* at the corner portions of the substrate 2*a*, the function of each of the lead-out conductors 31*a* and 31*b* is not different.

Figure 23B:
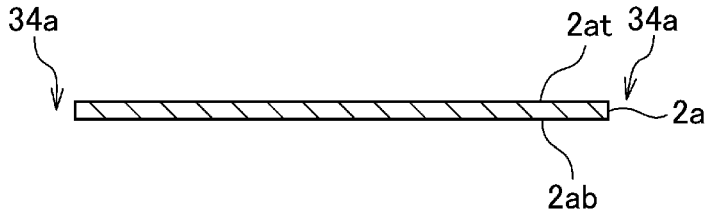

First, as illustrated in FIGS. 23A and 23B, the conductor-embedding through holes 32*s* and through holes 34*a* for forming a magnetic path are formed in the substrate 2*a*. The through holes 32*s* are provided in each of the rectangular areas in one by one manner. The through holes 34*a* are provided at the corner portions of each of the rectangular areas in one by one manner, and are provided also at the center portion of each of the planar spiral conductors 30*a* and 30*b*.

Figure 24A:
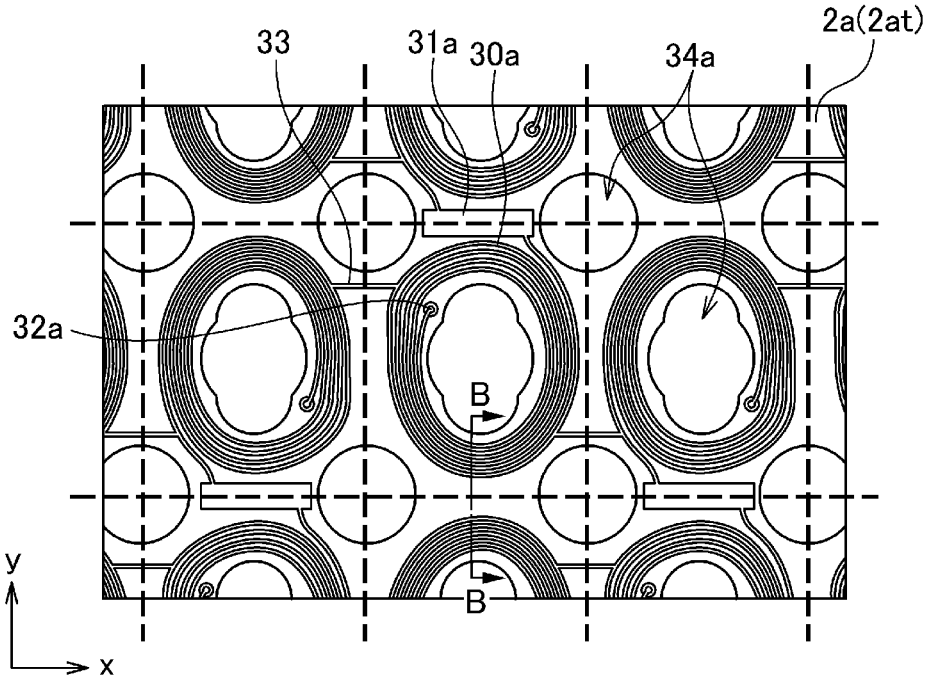
Figure 24B:
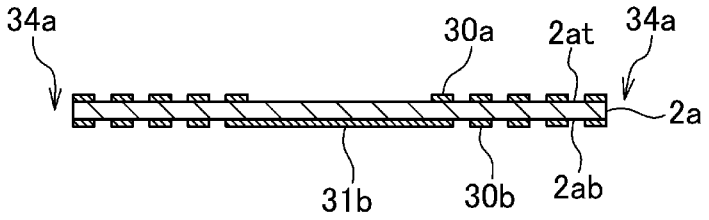

Then, as illustrated in FIGS. 24A and 24B, the planar spiral conductor 30*a* whose inner peripheral end covers the through hole 32*s* is formed for each rectangular area on the top surface 2*at* of the substrate 2*a*. Further, the lead-out conductor 31*a* to be connected to the outer peripheral end of the planar spiral conductor 30*a* is formed along one side of the rectangular area. The lead-out conductor 31*a* is shared between two adjacently disposed rectangular areas and is formed so as to be connected to the outer peripheral ends of the planar spiral conductors 30*a* formed in the two rectangular areas.

Similarly, on the back surface 2*ab* of the substrate 2*a*, the planar spiral conductor 30*b* whose inner peripheral end covers the through hole 32*s* is formed for each rectangular area. Further, the lead-out conductor 31*b* to be connected to the outer peripheral end of the planar spiral conductor 30*b* is formed along one of the four sides of the rectangular area that is opposed to the lead-out conductor 31*a*. The lead-out conductor 31*b* is also shared between two adjacently disposed rectangular areas and is formed so as to be connected to the outer peripheral ends of the planar spiral conductors 30*b* formed in the two rectangular areas.

Further, on both the top surface 2*at* and back surface 2*ab* of the substrate 2*a*, planar conductors 33 connecting adjacent two planar spiral conductors in an x-direction are formed. The planer conductors 33 are formed for causing plating current to flow in both x- and y-directions in the second electrolytic plating process to be described later.

A specific formation method of the planar spiral conductors 30*a* and 30*b*, etc. in a stage illustrated in FIG. 24 is as follows. That is, a Cu base layer is formed on both surfaces of the substrate 2*a* by the electroless plating process, and a photoresist layer is electrodeposited on a surface of the base layer. This base layer is formed also inside each of the through holes 32*s* to constitute the through hole conductor 32*a*. Subsequently, photolithography is performed on a one surface-by-one surface basis to form opening patterns (negative patterns) corresponding to a shape of the planar spiral conductors 30*a* and 30*b*, the lead-out conductors 31*a* and 31*b*, and the planar conductors 33. Then, the electrolytic plating is performed to form a plating layer inside each opening pattern. After removal of the photoresist layer, a portion of the base layer other than a portion where the plating layer is formed is removed by etching. The electrolytic plating performed here corresponds to the above-mentioned first electrolytic plating process. At this time, the base layer is a plate-like conductor that has not been subjected to patterning, so that a problem relating to a plating current flow direction does not occur. With the above processes, the planar spiral conductors 30*a* and 30*b*, lead-out conductors 31*a* and 31*b*, and planar conductors 33 each of which includes the base layer and plating layer are formed.

The conductors thus formed on the top surface 2*at* and back surface 2*ab* of the substrate 2*a* serve as the seed layers in the second electrolytic plating process. The seed layers are connected to each other through the lead-out conductors 31*a* and 31*b*, through hole conductors 32*a*, and planar conductors 33 in both the x- and y-directions, so that the plating current can be made to flow in both the x- and y-directions in the second electrolytic plating process.

Figure 25A:
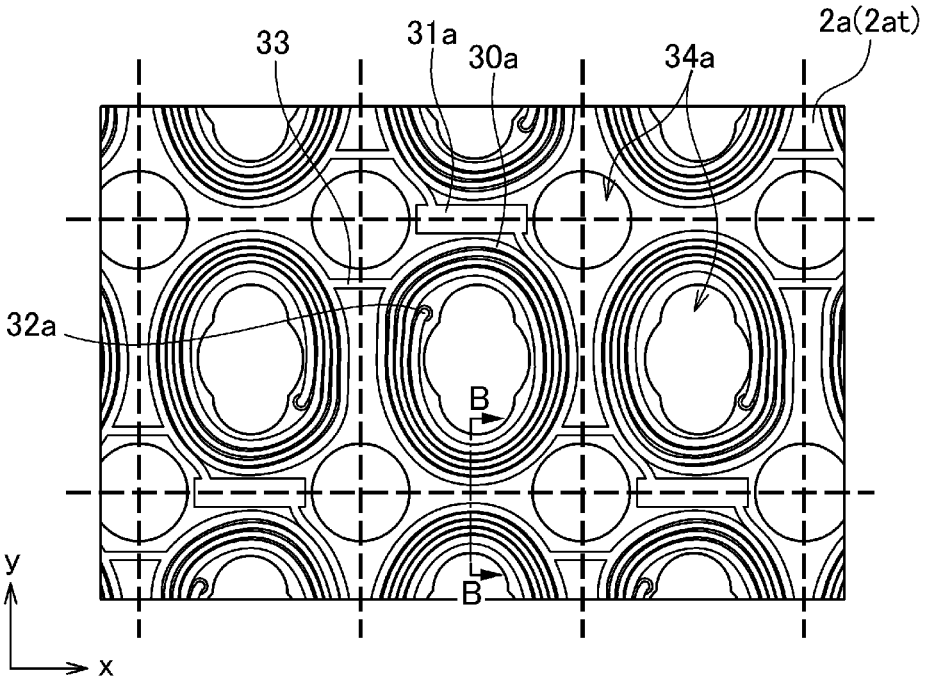
Figure 25B:
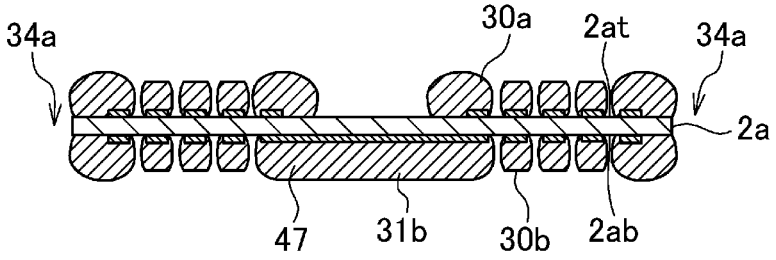

Subsequently, as illustrated in FIGS. 25A and 25B, the second electrolytic plating process is performed. Specifically, the substrate 2*a* before cutting is immersed in the plating liquid while the plating current is made to flow through the conductors serving as the seed layers from an end portion of the substrate 2*a*. The seed layers are connected to each other in both the x- and y-directions as described above, so that the plating current flows in both the x- and y-directions. As a result, metal ions are electrodeposited onto the planar spiral conductors 30*a* and 30*b*, etc., to form the plating layer 47.

Figure 26A:
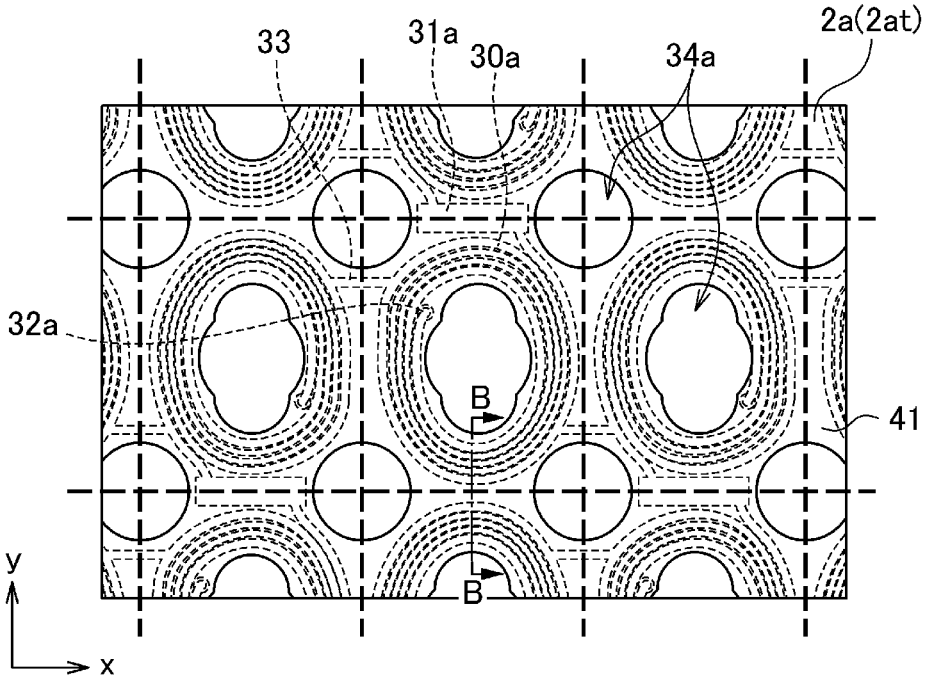
Figure 26B:
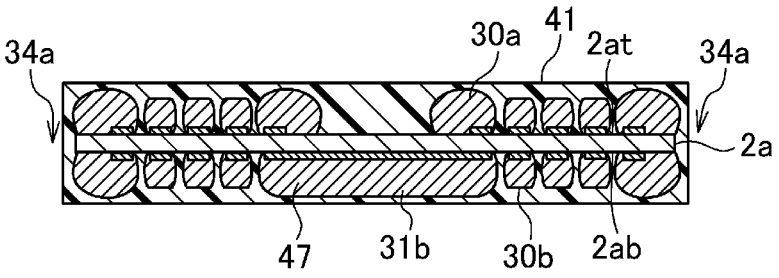
Figure 27A:
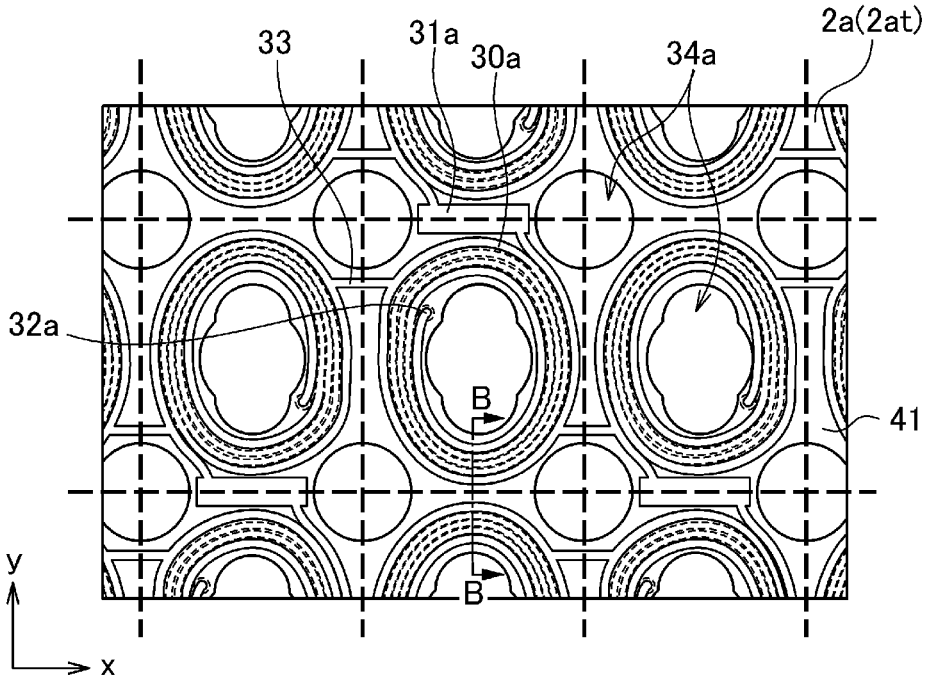
Figure 27B:
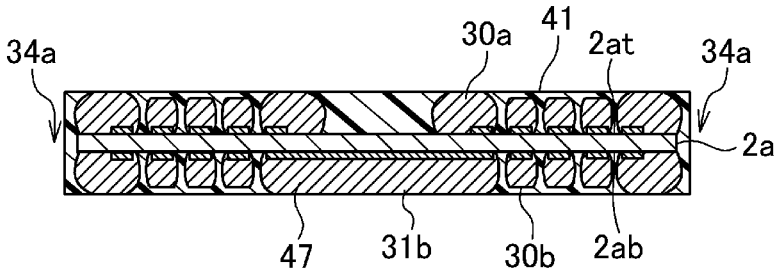

Subsequently, as illustrated in FIGS. 26A and 26B, the insulating resin is formed on the both surfaces of the substrate 2*a* to cover the conductors and plating layer 47 with the insulating resin layer 41 (first insulating resin layer). At this time, a side wall of the through hole 34*a* is covered with the insulating resin layer 41; however, it is necessary to prevent the entire region of the through hole 34*a* from being filed up with the insulating resin layer 41. Thereafter, as illustrated in FIG. 27, the both surfaces of the substrate 2*a* are ground. The grinding is performed such that the top surfaces of portions each having a relatively large thickness, such as the outermost and innermost turns of each of the planer spiral conductors 30*a* and 30*b* and lead-out conductor 31*b* are exposed, and the top surfaces of other portions each having a relatively small thickness are not exposed.

Then, as illustrated in FIG. 28, the insulating resin is formed once again on the top surface 2*at* side of the substrate 2*a* to cover once again the top surface of the exposed planar spiral conductor 30*a*, etc., with the insulating resin layer 41.

The same processes are applied as for the basic coil component 1*b*. That is, the planar spiral conductors 30*c* and 30*d*, lead-out conductors 31*c* and 31*d*, and through hole conductors 32*b* are formed on the substrate 2*b*. Then, the both surfaces of the resultant substrate 2*b* is covered with the insulating resin layer 41 (second insulating resin layer), and grinding is applied to the both surfaces of the substrate 2*b* to the same degree as for the basic coil component 1*a*. Thereafter, the insulating resin is formed once again on the back surface 2*bb* side of the substrate 2*b* to cover once again the top surface of the exposed planar spiral conductor 30*d*, etc., with the insulating resin layer 41.

After the basic coil components 1*a* and 1*b* are formed in the manner as described above, the two basic coil components 1*a* and 1*b* are laminated such that the back surface 2*ab* of the substrate 2*a* and top surface 2*bt* of the substrate 2*b* face each other, as illustrated in FIG. 28.

After the lamination, the top surface 2*at* of the substrate 2*a* and back surface 2*bb* of the substrate 2*b* are covered with the metal-magnetic-powder-containing resin layer 42. Specifically, a UV tape (not illustrated) for preventing warpage of the substrates 2*a* and 2*b* is attached to the back surface 2*bb* of the substrate 2*b*, and the metal-magnetic-powder-containing resin paste is screen-printed on the top surface 2*at* of the substrate 2*a*. In place of the UV tape, a thermal release tape may be used. A thickness of a screen sheet formed of the metal-magnetic-powder-containing resin paste is preferably about 0.27 mm. After the screen printing, defoaming is performed, and then heating is performed at a temperature of 80° C. for 30 minutes, to temporarily cure the resin paste. Subsequently, the UV tape is removed, and the metal-magnetic-powder-containing resin paste is screen-printed on the back surface 2*bb* of the substrate 2*b*. Similarly, a thickness of a screen sheet formed of the metal-magnetic-powder-containing resin paste is preferably about 0.27 mm. After the screen printing, heating is performed at a temperature of 160° C. for one hour to fully cure the metal-magnetic-powder-containing resin paste. As a result, the metal-magnetic-powder-containing resin layer 42 is obtained.

With the above processes, the metal-magnetic-powder-containing resin layer 42 is embedded also in the through holes 34*a* and 34*b*. As a result, a through hole magnetic body including the through hole magnetic body 42*a* illustrated in FIGS. 17 and 18 is formed in the through holes 34*a* and 34*b*.

Finally, a dicer is used to cut the substrates 2*a* and 2*b* along the cutting lines. As a result, individual coil components 1 corresponding to respective rectangular areas are obtained. Then, as illustrated in FIG. 18, the insulating layer 43 is formed on the surface of the metal-magnetic-powder-containing resin layer 42. After that, the external electrodes 45 and 46 illustrated in FIG. 17 are formed by sputtering and the like, whereby the manufacturing of the coil component 1 is completed.

As described above, according to the manufacturing method of the coil component 1 of the present embodiment, it becomes possible to produce the coil component 1 in which the top surfaces of the innermost and outermost turns of the respective planar spiral conductors 30*b* and 30*c* and the top surfaces of the lead-out conductors 31*b* and 31*c* are brought into contact and conduction with each other, whereas the top surfaces of the turns of the planar spiral conductor 30*b* other than the innermost and outermost turns, and turns of the planar spiral conductor 30*c* other than the innermost and outermost turns are electrically isolated from each other by the insulating resin film 41. Thus, it is possible to obtain a coil component in which a low DC resistance, a high inductance, and a reduction in height are achieved in a balanced manner.

Further, grinding is applied also to the planar spiral conductors 30*a* and 30*d*, so that the height of the coil component 1 is correspondingly further reduced.

Formation of the through hole magnetic bodies respectively at the corner portions of the substrates 2*a* and 2*b* (substrates 2*a* and 2*b* after cutting) and at the portions corresponding to the center portions of the planar spiral conductors 30*a* and 30*b* allows an increase in inductance of the coil component as compared with a case where the through hole magnetic bodies are not formed.

Further, the through hole 34*a* for forming a pangenetic path is formed before formation of the planar spiral conductors 30*a* and 30*b* and lead-out conductors 31*a* and 31*b*, so that the planar spiral conductors 30*a* and 30*b* can be formed so as to protrude in the through hole 34*a*, as illustrated in FIG. 18. Thus, it is possible to substantially increase a formation area of the planar spiral conductors 30*a* and 30*b*. The same can be said for the planer spiral conductors 30*c* and 30*d*.

Further, the magnetic path is formed not by the magnetic substrate, but by the metal-magnetic-powder-containing resin layer 42, so that it is possible to obtain a power supply choke coil excellent in DC superimposition characteristics.

Figure 29:
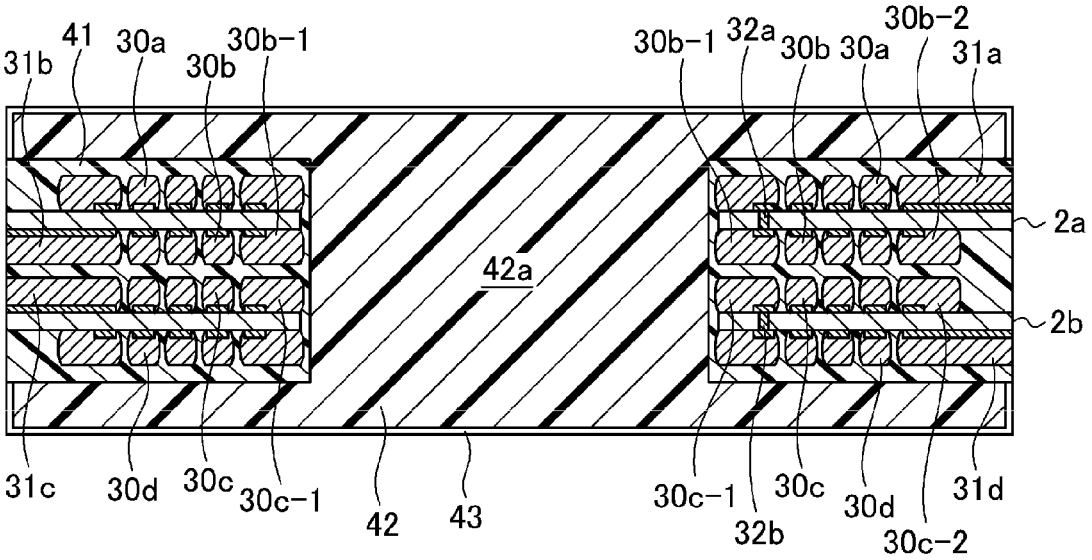
FIG. 29 is a cross-sectional view of the coil component according to a ninth embodiment of the present invention.

FIG. 29 is a cross-sectional view of the coil component 1 according to a ninth embodiment of the present invention. FIG. 29 corresponds to the cross-sectional view of FIG. 18.

As illustrated in FIG. 29, the coil component 1 according to the present embodiment differs from the coil component 1 according to the eighth embodiment in that the film thicknesses of the turns (including the lead-out conductor 31*b*) of the planar spiral conductors 30*b* are uniform, and the film thicknesses of the turns (including the lead-out conductor 31*c*) of the planar spiral conductors 30*c* are also uniform. Further, in the coil component 1 of the present embodiment, the film thicknesses of the turns (including the lead-out conductor 31*a*) of the planar spiral conductors 30*a* are uniform, and the film thicknesses of the turns (including the lead-out conductor 31*d*) of the planar spiral conductors 30*d* are also uniform. The uniformity in the film thicknesses is achieved by performing grinding in the above-mentioned grinding process to such a degree that the top surfaces of portions each having a relatively small thickness, such as turns other than the innermost and outermost turns of each planar spiral conductor, are exposed.

In the manufacturing process of the coil component 1 according to the present embodiment, film formation of the insulating resin after the grinding is applied also to at least one of the back surface 2*ab* of the substrate 2*a* and top surface 2*bt* of the substrate 2*b* (formation of a third insulating resin layer). As a result, as illustrated in FIG. 29, the top surfaces of the respective turns of the planar spiral conductor 30*b* and top surfaces of the respective turns of the planar spiral conductor 30*c* are electrically isolated from each other by the insulating resin layer 41. Thus, even if the coil-turn displacement occurs, the contact between a given turn of one of the planar spiral conductors 30*b* and 30*c* and a different turn of the other one thereof does not occur. In addition, it is possible to reduce, to the same extent as in the eighth embodiment, the distance between the basic coil components 1*a* and 1*b*. That is, also in the coil component 1 of the present embodiment, it is possible to reduce to the extent possible the distance between the basic coil components 1*a* and 1*b* without causing the degradation in the electrical and magnetic characteristics.

Further, also in the present embodiment, the grinding is applied also to the planar spiral conductors 30*a* and 30*d*, so that the height of the coil component 1 is correspondingly further reduced.

Although the eighth and ninth embodiments of the present invention are described above, the invention is not limited to the embodiments. It is a matter of course that the present invention can be conducted in various embodiments without departing from the scope of the present invention.

For example, in both the eighth and ninth embodiments, the top surfaces of the planar spiral conductors and those of the lead-out conductors are subjected to grinding to one degree or another. However, the grinding is conducted for the purpose of increasing the inductance and reducing the height of the coil component, and if such requirements are not made, the grinding may be omitted.

Figure 30:
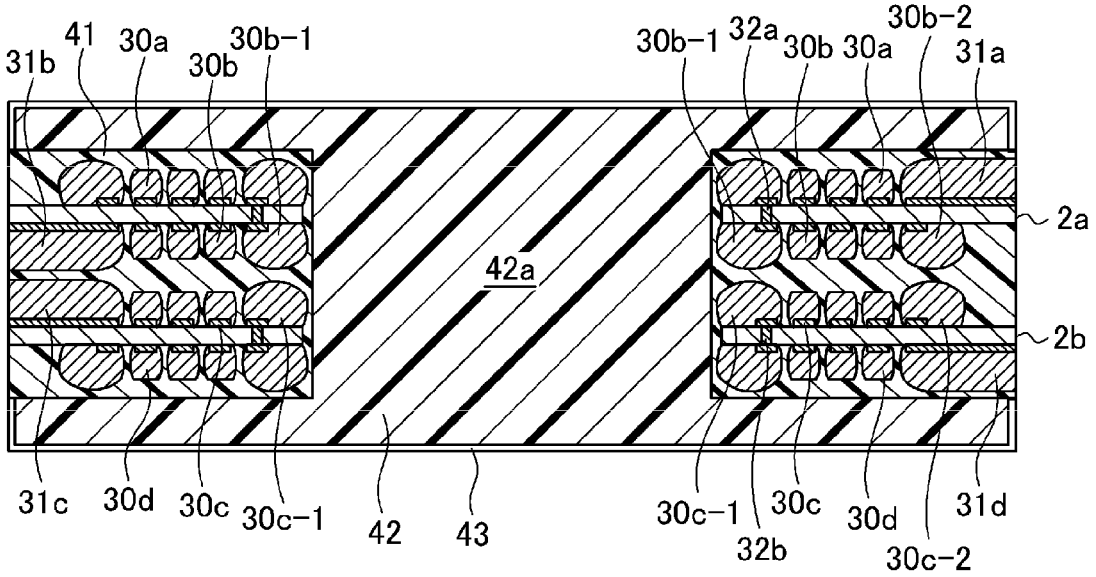
FIG. 30 is a cross-sectional view of the coil component according to a modification of the eighth and ninth embodiments of the present invention.

FIG. 30 is a cross-sectional view of the coil component 1 in which the grinding is not performed. As compared with the examples of FIGS. 18 and 29, a distance between the substrates 2*a* and 2*b* is slightly increased and, correspondingly, the height of the coil component 1 is increased. Further, the increase in the distance between the substrates 2*a* and 2*b* reduces the inductance of the coil component 1. However, the DC resistance can sufficiently be reduced in this configuration, so that when it is not necessary to achieve a high inductance and a reduction in height, the configuration of FIG. 30 may be adopted. The coil component illustrated in FIG. 30 can be easily obtained by simply putting the two basic coil components before cutting illustrated in FIG. 26 one over the other.

Figure 15A:
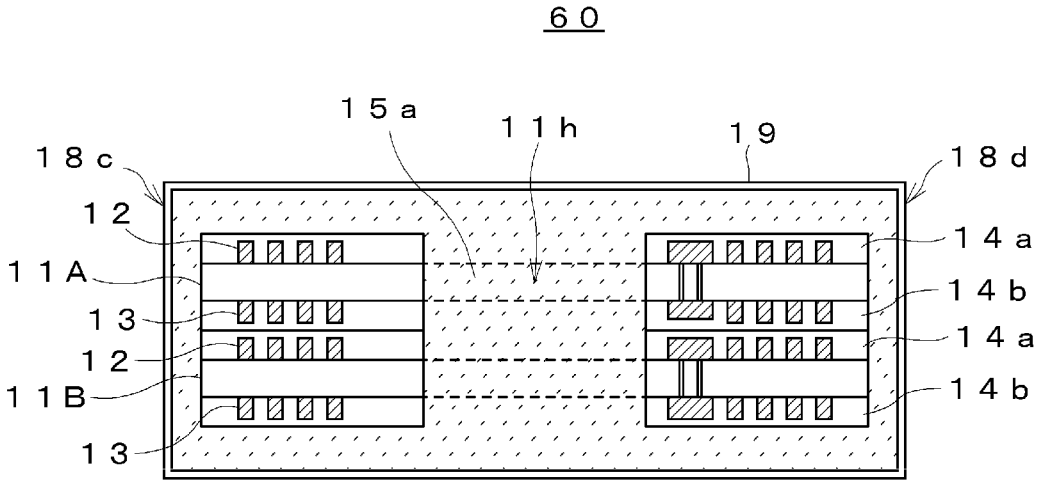
FIGS. 15A and 15B schematic side cross-sectional views illustrating a structure of a coil component 60 according to a sixth embodiment of the present invention.
Figure 15B:
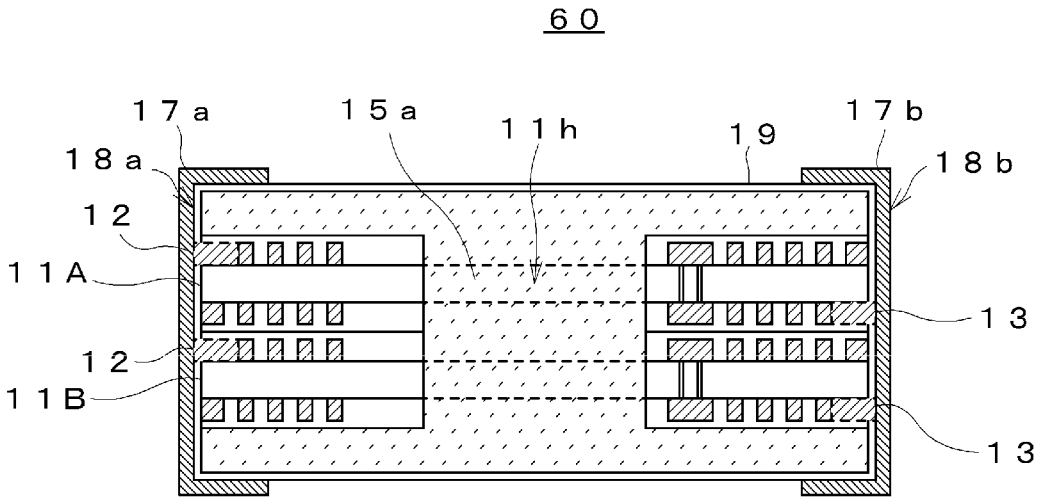

Further, in the coil component 1 described in the eighth and ninth embodiments, the metal-magnetic-powder-containing resin layer 42 corresponding to the upper and lower cores 15 and 16 described in the first to seventh embodiments has the through hole magnetic body 42*a* corresponding to the connection portion 15*a*; however, in place of, or in addition to the through hole magnetic body 42*a*, a through hole magnetic body corresponding to the connection portion 15*b* or connection portion 15*d* may be formed in the metal-magnetic-powder-containing resin layer 42. The coil component 60 illustrated in FIGS. 15A and 15B is an example obtained by forming the through hole magnetic body corresponding to the connecting portion 15*a* and those corresponding to the connecting portions 15*b* in the coil component 1 illustrated in FIG. 29. With the above configuration, it is possible to provide a small-sized and thin coil component, wherein opposing second and third planar spiral conductors are prevented from being brought into contact with each other, and which has excellent DC superimposition characteristics and high dimension processing accuracy, while being not required to form a magnetic gap.

REFERENCE SIGNS LIST

1, 10, 20, 30, 40, 50, 60, 70 coil component
1*a*, 1*b* basic coil component
2*a*, 2*b* substrate
2*at* top surface of the substrate 2*a*
2*ab* back surface of the substrate 2*a*
2*ax*, 2*ay* side surface of the substrate 2*a*
2*bt* top surface of the substrate 2*b*
2*bb* back surface of the substrate 2*b*
2*bx*, 2*by* side surface of the substrate 2*b*
11, 11A, 11B insulating substrate
11*a* upper surface of the insulating substrate
11*b* back surface of the insulating substrate
11*g* slit
11*h* opening of the center portion
11*i* through hole conductor (through hole)
11*k* opening pattern at four corners (common)
11*m* opening pattern at four corners (independent)
12 first spiral conductor
12*a* inner peripheral end of first spiral conductor
12*b* outer peripheral end of first spiral conductor
13 second spiral conductor
13*a* inner peripheral end of the second spiral conductor
13*b* outer peripheral end of the second spiral conductor
14*a*, 14*b* insulating resin layer
15 upper core
15*a* connecting portion (center)
15*b* connecting portion (outside)
15*d* connecting portion (four corners)
15*p* resin paste for the upper core
16 lower core
16*p* resin paste for the lower core
17*a*, 17*b* terminal electrode
17*c* terminal electrode for series connection
17*d* dummy electrode
18*a* first side surface of the laminated body
18*b* second side surface of the laminated body
18*c* third side surface of the laminated body
18*d* fourth side surface of the laminated body
19 insulating film
21 TFC substrate
22 UV tape
23 lower core (ferrite substrate)
24 short-circuiting conductor pattern
30*a* to 30*d* planar spiral conductor
31*a* to 31*d* lead-out conductor
32*a*, 32*b* through hole conductor
32*s*, 32*t* conductor-embedding through hole
33 planar conductor
34*a*, 34*b* through hole for forming a pangenetic path
41 insulating resin layer
42 metal-magnetic-powder-containing resin layer
42*a* through hole magnetic body
43 insulating layer
45, 46 external electrode
47 plating layer
51 insulating film formed of an Ni-based-ferrite-containing resin
52 slit
71A coil on the insulating substrate 11A
71B coil on the insulating substrate 11B
Cx, Cy cutting line
L1 to L6 inductor

What is claimed is:

1. A coil component comprising:

at least one insulating substrate having a first main surface, a second main surface opposite to the first main surface, a first side surface located along a first line, a second side surface located along a second line parallel to the first line, a third side surface located along a third line perpendicular to the first and second lines, a fourth side surface located along a fourth line parallel to the third line, a first notch formed at a vertex of the first and third lines, a second notch formed at a vertex of the second and third lines, a third notch formed at a vertex of the second and fourth lines, and a fourth notch formed at a vertex of the first and fourth lines;

a spiral conductor formed on at least the first main surface of the insulating substrate;

an upper core covering the first main surface of the insulating substrate;

a lower core covering the second main surface of the insulating substrate; and first to fifth connecting portions each having pillar shape extending in normal direction of the first and second main surfaces, each of the first to fifth connecting portions being attached to the upper core at an upper end and being attached to the lower core at a lower end so as to physically connect the upper and lower cores, the first to fourth connecting portions being located in the first to fourth notches, respectively, the fifth connecting portion penetrating the insulating substrate, wherein at least one of the upper and lower cores is formed of a metal-magnetic-powder-containing resin.

2. The coil component according to claim 1, wherein each of the first to fourth connecting portions is disposed in contact with an edge of the insulating substrate.

3. The coil component according to claim 1, wherein the first to fourth connecting portions are disposed inward of an area defined by the first to fourth lines.

4. The coil component according to claim 1, further comprising a plating conductor pattern formed on the one main surface of the insulating substrate, wherein one end of the plating conductor pattern is electrically connected to the spiral conductor, the other end of the plating conductor pattern extends up to the edge of the insulating substrate, and the plating conductor pattern, at the mass production time when a plurality of coil components are formed on a single substrate, constitutes a part of a short-circuiting pattern electrically connecting the spiral conductors of adjacent coil components.

5. The coil component according to claim 1, further comprising:

a pair of terminal electrodes formed on outer peripheral surfaces of a laminated body constituted by the insulating substrate and the upper and lower cores; and an insulating film covering surfaces of the upper and lower cores, wherein the insulating film is interposed between the pair of terminal electrodes and the upper and lower cores.

6. The coil component according to claim 5, wherein the insulating film is an insulating layer obtained by chemical conversion treatment using iron phosphate, zinc phosphate, or zirconia dispersed solution.

7. The coil component according to claim 6, wherein the insulating film is formed of an Ni-based-ferrite-containing resin.

8. The coil component according to claim 1, comprising a plurality of the insulating substrates, wherein the plurality of insulating substrates are laminated substantially without intervention of the metal-magnetic-powder-containing resin, and the spiral conductors formed on the respective insulating substrates are connected in parallel or in series through the pair of terminal electrodes.

9. The coil component according to claim 1, wherein both the upper and lower cores are formed of the metal-magnetic-powder-containing resin.

10. The coil component according to claim 1, wherein one of the upper and lower cores is formed of the metal-magnetic-powder-containing resin and the other one of the upper and lower cores is formed of a ferrite substrate.

* * * * *